US006416074B1

(12) United States Patent
Maravetz et al.

(10) Patent No.: US 6,416,074 B1
(45) **Date of Patent: *Jul. 9, 2002**

(54) STRAP FOR A SNOWBOARD BOOT, BINDING OR INTERFACE

(75) Inventors: Paul T. Maravetz; Joshua S. Reid, both of Stowe; Peter M. Curran, Burlington; Graham S. Taylor, Moscow, all of VT (US)

(73) Assignee: The Burton Corporation, Burlington, VT (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/333,647

(22) Filed: Jun. 15, 1999

(51) Int. Cl.[7] ..... A63C 9/00; A63C 9/99

(52) U.S. Cl. ..... 280/624; 280/121.21; 280/613; 36/119.1

(58) Field of Search ..... 280/14.21, 14.22, 280/14.24, 613, 617, 618, 624, 625; 36/50.1, 119.1, 117.4, 117.9, 118.1, 115

(56) References Cited

U.S. PATENT DOCUMENTS

| | | | |
|---|---|---|---|
| 61,487 | A | 1/1867 | Vollschwitz |
| 746,563 | A | 12/1903 | McMahon |
| 908,704 | A | 1/1909 | Sprinkle |

(List continued on next page.)

FOREIGN PATENT DOCUMENTS

| | | | |
|---|---|---|---|
| AP | 43b/151456 | | 5/1972 |
| CH | 677313 | A | 5/1991 |
| DD | 89796 | | 11/1970 |
| DE | 89796 | | 4/1896 |
| DE | 2341658 | | 3/1974 |
| DE | 2900077 | | 7/1980 |
| DE | 3626837 | | 2/1988 |
| DE | 3644036 | | 8/1988 |
| DE | 3813470 | | 11/1989 |
| DE | 3900777 | | 7/1990 |
| DE | 3932023 | | 4/1991 |
| EP | 0056935 | | 8/1982 |
| EP | 0056953 | | 8/1982 |
| EP | 0099504 | | 2/1984 |
| EP | 0132744 | | 2/1985 |
| EP | 0201051 | | 11/1986 |
| EP | 0204945 | | 12/1986 |
| EP | 0255869 | | 2/1988 |
| EP | 0264712 | | 4/1988 |
| EP | 0368798 | | 5/1990 |
| EP | 0393380 | | 10/1990 |
| EP | 0412 290 | B1 | 2/1991 |
| EP | 0433639 | | 6/1991 |
| EP | 0474708 | | 3/1992 |
| EP | 0559648 | | 9/1993 |
| EP | 0 787 512 | A1 | 8/1997 |
| EP | 0 812 552 | A1 | 12/1997 |
| EP | 0 836 869 | A2 | 4/1998 |
| EP | 0 839 557 | A1 | 5/1998 |
| EP | 0 852 958 | A1 | 7/1998 |
| FR | 1374110 | | 1/1965 |
| FR | 2108429 | | 5/1972 |
| FR | 2569087 | | 2/1986 |

OTHER PUBLICATIONS

International Search Report dated Dec. 18, 2000 from International Application No. PCT/US00/40184.
Derwent World Patent Index Family Search for Foreign Patent Documents.

*Primary Examiner*—Lanna Mai
*Assistant Examiner*—Hau Phan
(74) *Attorney, Agent, or Firm*—Wolf, Greenfield & Sacks

(57) ABSTRACT

An apparatus comprising a snowboard boot and a strap to hold down a rider's foot in the snowboard boot. The strap includes a tightening element attached to the snowboard boot, a strap body supported by the tightening element, and a closure device including a spool about which the tightening element is wrapped to tighten the strap down onto the snowboard boot. In one aspect, the closure device includes a body and an actuator that is rotatably mounted to the body and is coupled to the tightening element so that rotation of the actuator causes the tightening element to be drawn into the closure device body to tighten the strap.

111 Claims, 11 Drawing Sheets

1,060,422 A 4/1913 Bowdish
1,393,188 A 10/1921 Whiteman
1,408,563 A 3/1922 Conger
1,416,203 A 5/1922 Hobson
1,469,661 A 10/1923 Migita
1,481,903 A 1/1924 Hart
1,489,126 A 4/1924 Jansizian
1,494,653 A 5/1924 Walters
1,530,713 A 3/1925 Clark
2,109,751 A 3/1938 Matthias et al.
2,345,057 A 3/1944 Marinetti
2,893,090 A 7/1959 Pagoda
2,994,935 A 8/1961 Buchholz
3,112,545 A 12/1963 Williams
3,163,900 A 1/1965 Martin
3,538,627 A * 11/1970 Labat-Camy ..... 36/117.4
3,703,775 A 11/1972 Gatti
3,738,027 A 6/1973 Schoch
3,793,749 A 2/1974 Gertsch et al.
3,808,644 A 5/1974 Schoch
4,130,949 A 12/1978 Seidel
4,261,081 A 4/1981 Lott
4,360,979 A 11/1982 Spademan
4,433,456 A 2/1984 Baggio
4,551,932 A 11/1985 Schoch
4,557,061 A * 12/1985 Graillat et al. ..... 36/117.9
4,565,017 A 1/1986 Ottieri
4,571,855 A 2/1986 Blanc
4,574,500 A 3/1986 Aldinio et al.
4,593,483 A * 6/1986 Paris ..... 36/118.1
4,616,524 A 10/1986 Bidoia
4,620,378 A 11/1986 Sartor
4,620,379 A 11/1986 Sator
4,633,599 A 1/1987 Morell et al.
4,653,204 A 3/1987 Morell et al.
4,654,985 A 4/1987 Chalmers
4,660,300 A 4/1987 Morell et al.
4,660,303 A 4/1987 Courvoisier et al.
4,669,201 A 6/1987 Pozzobon
4,669,202 A 6/1987 Ottieri
4,670,949 A 6/1987 Autry
4,680,878 A 7/1987 Pozzobon et al.
4,719,670 A 1/1988 Kurt
4,719,709 A 1/1988 Vaccari
4,719,710 A 1/1988 Pozzobon
4,735,004 A 4/1988 Dodge
4,741,115 A 5/1988 Pozzobon
4,741,550 A 5/1988 Dennis
4,748,726 A 6/1988 Schoch
4,754,560 A 7/1988 Nerrinck
4,756,099 A 7/1988 Walkhoff
4,757,621 A 7/1988 Iwama
4,759,137 A 7/1988 Lederer
4,760,653 A 8/1988 Baggio
4,761,859 A 8/1988 Calabrigo
4,780,969 A 11/1988 White, Jr.
4,787,124 A 11/1988 Pozzobon et al.
4,796,829 A 1/1989 Pozzobon et al.
4,799,297 A 1/1989 Baggio et al.
4,817,303 A 4/1989 Selbiger
4,841,649 A 6/1989 Baggio
4,870,723 A 10/1989 Pozzobon et al.
4,870,761 A 10/1989 Tracy
4,884,760 A 12/1989 Baggio et al.
4,916,836 A 4/1990 Baggio et al.
4,937,951 A 7/1990 Loecker
4,937,952 A 7/1990 Olivieri
4,937,953 A 7/1990 Walkhoff
4,961,544 A 10/1990 Bidoia
4,999,889 A 3/1991 LeCouturer
5,001,817 A 3/1991 De Bortoli et al.
5,012,598 A 5/1991 Baggio et al.
5,016,327 A 5/1991 Klausner
5,026,087 A 6/1991 Wulf et al.
5,042,177 A 8/1991 Schoch
5,044,654 A 9/1991 Meyer
5,048,204 A 9/1991 Tacchetto et al.
5,062,224 A 11/1991 Tacchetto
5,062,225 A 11/1991 Gorzo
5,065,480 A 11/1991 De Bortoli
5,065,481 A 11/1991 Walkhoff
5,117,567 A 6/1992 Berger
5,150,537 A 9/1992 Tacchetto et al.
5,152,038 A 10/1992 Schoch
5,157,813 A 10/1992 Carroll
5,158,559 A 10/1992 Pozzobon et al.
5,167,083 A 12/1992 Walkhoff
5,177,567 A 1/1993 Klersy et al.
5,177,882 A 1/1993 Berger
5,181,331 A 1/1993 Berger
5,184,378 A 2/1993 Batra
5,249,377 A 10/1993 Walkhoff
5,259,094 A 11/1993 Zepeda
5,319,868 A 6/1994 Hallenbeck
5,325,613 A 7/1994 Sussmann
5,327,662 A 7/1994 Hallenbeck
5,333,398 A 8/1994 Seo
5,341,583 A 8/1994 Hallenbeck
5,345,697 A 9/1994 Quellais
5,351,420 A 10/1994 Pozzobon et al.
5,355,596 A 10/1994 Sussmann
5,412,883 A 5/1995 Wulf et al.
5,416,987 A 5/1995 Bemis et al.
5,425,161 A 6/1995 Schoch
5,463,822 A 11/1995 Miller
5,502,902 A 4/1996 Sussmann
5,511,325 A 4/1996 Hieblinger
5,566,474 A 10/1996 Leick et al.
5,600,874 A 2/1997 Jungkind
5,606,778 A 3/1997 Jungkind
5,638,588 A 6/1997 Jungkind
5,647,104 A 7/1997 James
5,651,198 A 7/1997 Sussmann
5,669,116 A 9/1997 Jungkind
5,687,460 A 11/1997 Foffano et al.
5,722,680 A 3/1998 Dodge
5,737,854 A 4/1998 Sussmann
5,758,895 A 6/1998 Bumgarner
5,791,021 A 8/1998 James
5,791,068 A 8/1998 Bernier et al.
5,810,381 A 9/1998 Keller et al.
5,839,210 A 11/1998 Bernier et al.
5,927,744 A 7/1999 Knapschafer
5,934,599 A 8/1999 Hammerslag
5,966,841 A * 10/1999 Barret ..... 36/50.1
6,009,638 A * 1/2000 Maravetz et al. ..... 36/117.9
6,056,300 A * 5/2000 Carpenter et al. ..... 280/14.22
6,056,312 A * 5/2000 Hogstedt ..... 280/624
6,076,285 A * 6/2000 Caeran et al. ..... 36/115
6,099,018 A * 8/2000 Maravetz et al. ..... 280/264
6,289,558 B1 9/2001 Hammerslag

* cited by examiner

STRAP FOR A SNOWBOARD BOOT, BINDING OR INTERFACE

BACKGROUND OF THE INVENTION

1. Field of the Invention

This invention relates to snowboard boots and bindings, and more particularly to straps for use on snowboard boots, bindings and interfaces.

2. Related Art

Snowboarding, which has become an increasingly popular sport, typically involves the use of a snowboard, a pair of snowboard boots worn by a rider, and a snowboard binding that secures the snowboard boots to the snowboard. While there are other types of snowboard boots, the most widely used variety is known as a soft snowboard boot, which typically includes a soft and flexible upper made from a resilient material (e.g., leather). There are two primary types of snowboard bindings used with soft snowboard boots, i.e., tray bindings and step-in bindings. Tray bindings typically employ a rigid highback into which the heel of the boot is placed, and one or more straps that secure the boot to the binding. Conversely, step-in bindings have eliminated the need for binding straps, and provide the rider with the convenience of engaging the boot to the binding by simply stepping into the binding. Examples of step-in binding systems each of which are assigned to the present assignee and which are thereby incorporated herein by reference, include Examples of step-in binding systems each of which are assigned to the present assignee and which are thereby incorporated herein by reference, include U.S. Ser. No. 08/375,971, Snowboard Boot Binding Mechanism; U.S. Ser. No. 08/584,053, Method and Apparatus for Interfacing A Snowboard Boot to a Binding; U.S. Pat. No. 5,722,680, Step-in Snowboard Binding; U.S. Ser. No. 08/780,721, Step-in Snowboard Binding.

The development of soft boot step-in bindings has presented a problem not previously encountered. In particular, tremendous lifting forces are generated at the heel of a snowboard rider during riding. It is desirable to prevent the rider's foot, particularly the heel, from lifting from the bottom of the boot to maximize control. In a tray binding, the straps can be tightened down over the boot sufficiently to hold the rider's foot down and prevent heel lift. However, with a strapless soft boot step-in binding, the binding does not employ any straps to perform this function. Although the laces of the snowboard boot are available to resist lifting forces, the laces alone are often not capable of sufficiently holding down the heel of the boot to provide the desired control.

To hold down the rider's heel in the boot, many soft boots adapted for use with a step-in binding employ an ankle strap in addition to the lacing system used to close the front of the boot. The ankle strap is typically a two-piece strap including a ratchet tongue and a buckle mechanism. Each of the two strap components has a fixed end that is attached to one side of the boot, and a free end that is adapted to mate with the other strap component. Typically, the buckle mechanism is a ratchet type fastener to engage with the ratchet tongue, such that when tightening the strap typically involves, a relative sliding motion between the two strap components, with one of the components sliding between the boot and the other strap component.

When tightening a ratchet-type ankle strap attached to the boot in the manner described above, significant frictional forces between the strap and the boot can cause the strap to bear against the rider's foot in a non-uniform way, resulting in high pressure points that can be uncomfortable on the rider's foot. Compounding the problem is the fact that the two straps components lie in slightly different planes (with one component overlying the other), so that the tension extending through the two strap components can cause a moment tending to twist the buckle slightly, which can tend to dig the buckle into the boot, potentially creating another uncomfortable pressure point for the rider.

Two-piece ratchet-type straps of the type described above have also been used to form the straps (e.g., both a toe strap and a heel strap) in a tray binding, and in systems that employ an interface for attaching the snowboard boot to the binding, wherein the strap attaches the interface to the boot. While not as severe as when the strap is attached directly to the snowboard boot, the above-described issues involving the creation of pressure points bearing on the rider's foot can also be experienced when two-piece ratchet-type straps are employed on a tray binding, or are used to attach an interface to a snowboard boot.

SUMMARY OF THE INVENTION

In one illustrative embodiment of the invention, an apparatus is provided. The apparatus includes a snowboard boot binding interface for interfacing a snowboard boot to a snowboard binding and a strap to hold the interface to the snowboard boot. The strap includes a tightening element attached to the snowboard boot. The strap also includes a closure device including a spool about which the tightening element is wrapped to tighten the strap to secure the interface to the boot.

In another illustrative embodiment of the invention, an apparatus is provided. The apparatus includes a snowboard boot binding interface for interfacing a snowboard boot to a snowboard binding and a strap to hold the interface to the snowboard boot. The strap includes a tightening element attached to the interface. The strap also includes a closure device including a body and an actuator that is rotatably mounted to the body and is coupled to the tightening element so that rotation of the actuator causes the tightening element to be drawn into the closure device body to tighten the strap.

In yet another embodiment of the invention, an apparatus is provided. The apparatus includes a snowboard boot binding interface for interfacing a snowboard boot to a snowboard binding. The interface includes at least one strap anchor and a strap to hold the interface to the snowboard boot. The strap includes a tightening cable attached to the at least one anchor. The tightening cable is routed to and redirected by a portion of the at least one anchor so that the tightening cable can be drawn in one direction about the portion of the at least one anchor to tighten the strap.

In still another embodiment of the invention, an apparatus is provided. The apparatus includes a snowboard boot binding interface for interfacing a snowboard boot to a snowboard binding and a strap to hold the interface to the snowboard boot. The strap includes at least one load bearing strap component that is attached to the interface at first and second locations on opposite sides of the interface. The at least one load bearing strap component has a first portion that is attached to the first location on the interface and a second portion that is attached to the second location on the interface. The strap also includes a strap body movably mounted to each of the first and second portions of the at least one load bearing strap component and adapted to overlie the snowboard boot. The strap also includes a single closure device to tighten the strap by simultaneously tensioning the first and second portions of the at least one load bearing component and causing relative movement between the strap body and each of the first and second portions of the at least one load bearing component.

BRIEF DESCRIPTION OF THE DRAWINGS

Various embodiments of the invention will now be described, by way of example, with reference to the accompanying drawings, in which.

DETAILED DESCRIPTION

One illustrative embodiment of the present invention is directed to an improved strap that can be used in any of numerous applications, including for use as a strap (e.g., a heel strap) attached directly to a snowboard boot, as a strap (e.g., a toe strap or heel strap) in a tray binding, or as a strap for attaching a binding interface to a snowboard boot. In one embodiment, the strap employs a tightening mechanism that evenly distributes pressure throughout the strap, to avoid the creation of uneven pressure points as can occur with conventional two-piece ratchet-type straps of the type described above. In another embodiment, tightening of the strap does not result in a sliding movement of the strap across the surface of the snowboard boot, thereby avoiding the creation of significant frictional forces between the strap and the snowboard boot. In a further embodiment, the tensioned or load bearing components of the strap lie in a common plane, so that no moment is created as in conventional ratchet-type straps, thereby avoiding uncomfortable pressure points that can result therefrom.

Figure 1:
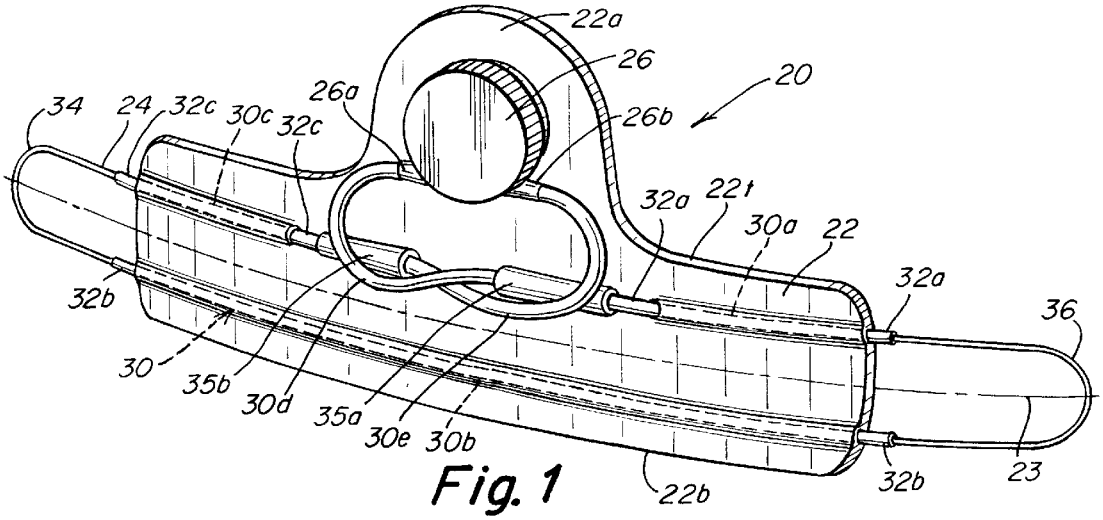
FIG. 1 is a perspective view of a boot securing strap according to one aspect of the present invention.

One illustrative embodiment of a strap 20 in accordance with the present invention is shown in FIG. 1. The strap 20 includes four major components, e.g., a strap body 22, a tightening element or load bearing strap component 24, a guide 30 for guiding the tightening element 24 across the strap body 22, and a closure device 26 that is used to tighten the tightening element 24. The tightening element 24 includes loop ends 34 and 36 that may be attached to anchors on a snowboard boot, a snowboard binding or a binding interface any of various ways as discussed below. As shown in FIG. 1, the tightening element 24 is guided via the guide 30 from one opening 26*a* of the closure device 26, through an upper portion 30*a* of the guide 30, to the loop end 36, through a lower portion 30*b* of the guide 30 to the loop end 34, and through a second upper portion 30*c* of the guide 30 back into the closure device 26 through a second opening thereof 26*b*.

Figure 2:
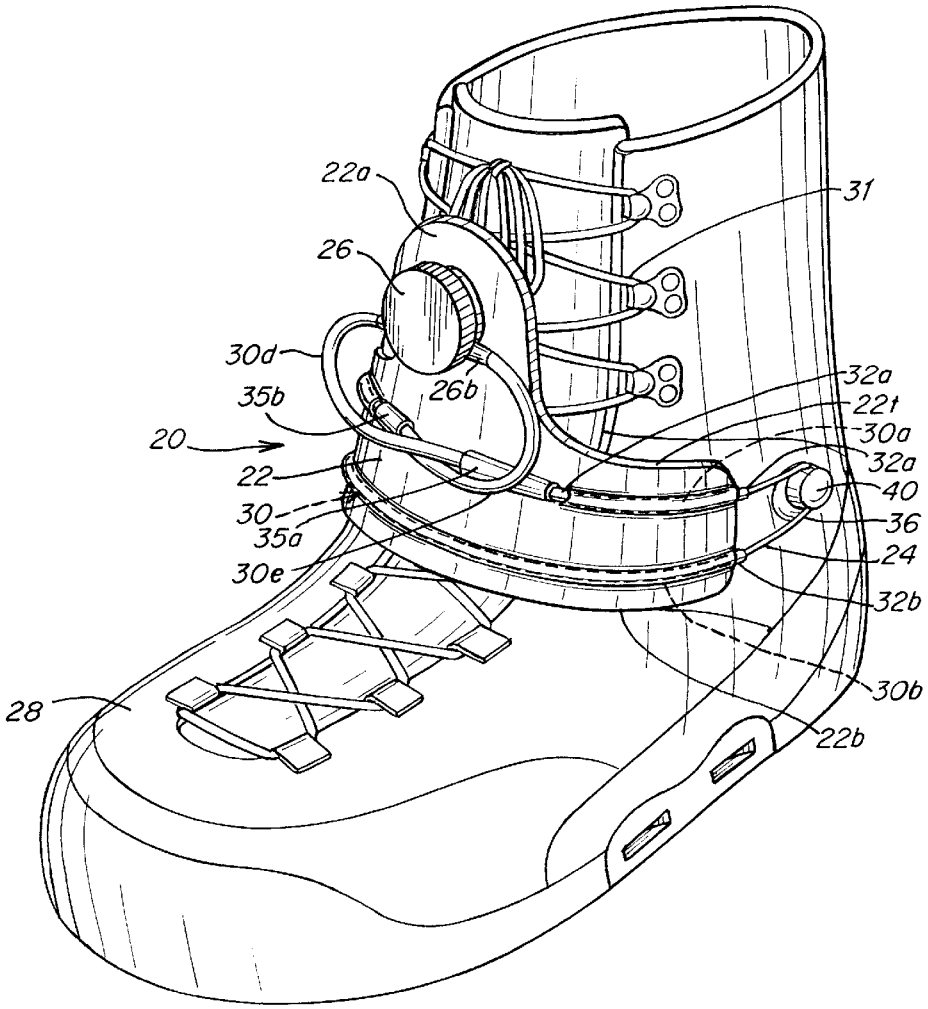
FIG. 2 is a perspective view showing the securing strap attached to a soft snowboard boot.

Operation of the strap 20 will now be described in connection with FIG. 2, which illustrates an embodiment of the present invention wherein the strap 20 is attached to a soft snowboard boot 28 that may include a lace 31 that closes the front of the boot. The boot includes a pair of anchors 40 (only of one of which is shown in FIG. 2) for mounting the loop ends 34 and 36 of the tightening element 24 to the boot. The anchors 40 can be implemented in any of numerous ways as discussed below. The closure device 26 tightens the strap 20 by taking up slack in the tightening element 24, so that the strap 20 is tightened down over the top surface of the snowboard boot. The closure device 26 can include a housing or body into which the tightening element 24 is drawn to take up the slack in the tightening element. The closure device can include a spool (not shown) about which the tightening element 24 can be wrapped to take up the slack therein. For example, the spool can be implemented as a substantially cylindrical body, that is rotatably mounted relative to the housing of the closure device. However, the spool can also be implemented in any of numerous other ways, and is not limited to any particular configuration. For example of the spool need not be cylindrical, as any of numerous other configurations (square, triangular, elliptical, hexagonal) can be employed. In addition, the spool could be provided as simply two or more spaced apart members about which the tightening element can be wrapped.

Preferably, the closure device 26 is capable of providing a plurality of incremental tightening positions, to provide the rider with tremendous flexibility in determining the desired tightness for the strap 20. In the illustrative embodiment shown in FIGS. 1–2, the closure device 26 is a rotary closure device having a spool around which the tightening element 24 is wound to take up the slack in the tightening element 24, and further including a ratchet and pawl to provide one-way incremental locking adjustments. Such closure devices are well known for use in other applications, such as for use with a cable tightening system to replace conventional laces in an athletic shoe, and examples of such rotary closure devices are described in U.S. Pat. Nos. 3,738,027; 3,808,644; 4,433,456; 4,616,524; 4,660,300; 4,748,726; 4,761,859; 4,787,124; 4,796,829; 4,841,649; 4,884,760; 4,961,544; 5,042,177; 5,065,481; 5,150,537; 5,152,038; 5,157,813; 5,325,613; 5,600,874; 5,606,778; 5,638,588; and 5,669,116; and European patent applications EP056,953 and EP264,712. It should be appreciated that the present invention is not limited to the use of any particular type of closure device, as any mechanism that is capable of taking up slack in the tightening element 24 and providing a plurality of tightening positions can be used in connection with the present invention.

In the illustrative embodiment shown in FIGS. 1–2, the closure device 26 is attached to the strap body 22 in a center area 22*a* thereof. However, it should be appreciated that the present invention is not limited in this respect, and that the closure device 26 can be attached in numerous other places on the strap body 22. Furthermore, as discussed below, in an alternative embodiment of the invention, the closure device 26 need not be mounted to the strap 20 at all, but rather, can be mounted to the snowboard boot, the binding or the binding interface with which the strap 20 is employed.

In use, the strap 20 can be disengaged to enable the rider to place his or her foot into the snowboard boot in any of numerous ways. In accordance with one embodiment of the present invention, a sufficient length of the tightening element 24 is provided within the closure device 26, so that when the closure device 26 is actuated to release the tightening element 24, sufficient slack can be provided therein to enable the rider to place his or her foot into the snowboard boot 28. Thereafter, the lace 31 on the boot, if used, can be tightened. Next, the tightening mechanism 26 can be actuated to take up the slack in the tightening element 24, thereby causing the strap 20 to cinch down over the top of the snowboard boot 28.

In an alternative embodiment of the invention, the anchor 40 on at least one side of the snowboard boot can be adapted to releasably engage the tightening element 24, so that the rider can disengage the strap 20 from one side of the snowboard boot to facilitate entry and exit of the rider's foot into the boot 28. When the rider is putting on the boot 28, and after placing his or her foot therein and tightening the lace 31, the free end of the strap 20 can be attached to its anchor 40. Thereafter, the closure device 26 can be actuated to reduce slack in the tightening element 24 and achieve the desired level of tightness in the strap 20.

As should be appreciated from the foregoing, when the strap 20 is tightened down onto the boot, the strap body 22 cinches down over the top of the boot. In this respect, when the tightening element 24 is tensioned, it can move relative to the strap body 22, so that the strap body 22 moves relative to the tightening element 24, toward the snowboard boot on both sides thereof. Thus, in contrast to conventional two-piece ratchet-type straps, there is no significant relative sliding between the strap body 22 and the upper surface of the boot 28, thereby avoiding the creation of uncomfortable pressure points that can be caused with conventional straps as discussed above. In addition, the strap components that are tensioned when the strap is tightened (i.e., the tightening element 24) can be located in a single plane, such that no moment is created on the strap as it is tightened as with conventional two-piece ratchet-type straps, thereby avoiding the uncomfortable pressure points that can result therefrom. In addition, since the strap 20 does not include two major strap components that overlie one another, the strap 20 has a low profile that can be integrated into the boot in an aesthetically pleasing manner.

The strap body 22 can be formed in any of numerous ways, as the present invention is not limited to any particular construction. The strap body 22 may be formed of any suitable material, such as plastic, leather, fabric or any suitable combination, and may be made using any suitable manufacturing technique, such as cutting, stamping, injection or compression molding or stitching. Although shown in the figures as a single component, it should be appreciated that the strap body 22 can be made of any number of components formed of a single or multiple materials, which may be joined together using any suitable joining technique (e.g., gluing, stitching, heat bonding, etc.). The strap body 22 may be rigid and shaped to conform to the portion of the boot 28 which it overlies. Alternatively, the strap body 22 may be flexible and resilient so that it will conform to the shape of the boot as the strap 20 is tightened down. Plastic components in the strap body 22 may be molded into the desired shape, whereas leather or fabric components in the strap body 22 may be stitched into the desired shape.

In one embodiment of the invention, the strap body 22 includes a padded support (not shown) disposed on an inner surface for increased comfort. In addition, the strap body 22 can be provided with an opening adapted to overlie the instep bone of the rider to further increase the comfort of the strap, as described in co-pending U.S. patent application Ser. No. 08/619,358, entitled Snowboard Boot and Binding Strap, which is hereby incorporated herein by reference. In one embodiment, the strap body 22 is sized to extend from substantially one side of the boot to the other, thereby maximizing distribution of pressure across the top surface of the boot 28. In addition, by extending from substantially one side of the boot to the other, the strap body 22 is essentially self-centering between the anchors 40. Although providing the advantages discussed above, it should be appreciated that the present invention is not limited to employing a strap body 22 that extends substantially the entire length between the anchors 40. For example, a smaller strap body 22 can be employed along with a guide 30 having ends 32 that extend well beyond the strap body 22 and are incompressible, so that the guides 30 can achieve the self-centering effect. Furthermore, although this self-centering feature is advantageous, it should be appreciated that the present invention is not limited in this respect, and that a strap 20 can be implemented in accordance with the teachings of the present invention without a self-centering capability.

The guides 30 can be implemented in any of numerous ways, and the present invention is not limited to any particular implementation. In this respect, the function performed by the guides 30 is to guide the tightening element 24 from the closure device 26, through the strap body 22 to the anchors 40. In the embodiment shown in FIG. 1, the guides 30 extend substantially along a longitudinal axis 23 of the strap body 22, which is advantageous in that a large portion of the strap body 22 is held down onto the boot 28 via the tightening element 24. However, it should be appreciated that the present invention is not limited in this respect, and that numerous other configurations for the guides 30 are possible. In the embodiment shown in FIG. 1, the guide 30 does not completely enclose the tightening element 24 (e.g., the tightening element exits the guide 30 at the loop ends 34 and 36), so that the length of the tightening element can be altered to tighten or loosen the strap 20 independently of the guide 30. In one embodiment of the invention, the guide 30 can be formed of a low-friction high abrasion resistant material, to minimize friction between the tightening element 24 and the guide 30, and thereby facilitate even distribution of the tightening pressure exerted by the tightening element 24 on the strap body 22. Although advantageous, it should be appreciated that the present invention is not limited to the use of a low-friction and/or high abrasion resistant material for the guide 30.

In the embodiment shown, the guide 30 includes five distinct components, e.g., upper guide components 30*a* and 30*c*, each of which is disposed within and extends beyond a lumen (indicated by the dotted lines in FIG. 1) in the strap body 22, a lower guide component 30*b* that is similarly disposed within a lumen in the strap body 22 and extends therebeyond at each of its ends, and upper guide components 30*d* and 30*e* that respectively couple the guide components 30*a* and 30*c* to the closure device 26. The strap 20 further includes a pair of connectors 35*a* and 35*b* that respectively connect the guide components 30*a* and 30*c* to the guide components 30*d* and 30*e*. It should be appreciated that the present invention is not limited to the particular implementation shown, and that the guide 30 can be formed in numerous other configurations to route the tightening element 24 through sufficient portions of the strap body 22 to effectively hold the strap 20 down atop the boot 28.

In the embodiment shown in FIG. 1, the upper portion of the guide 30 extending toward each side of the strap body 22 is formed from two components (e.g., guide components 30*a* and 30*d* that route the tightening element from the closure device 26 to the right side of the strap body 22 in FIG. 1, and guide components 30*c* and 30*e* that guide the tightening element to the left side of the strap body 22). While each of the two components of the guide 30 that route the tightening element from the closure device 26 to one side of the strap body 22 can be formed from a low-friction high abrasion resistant material, in one embodiment of the present invention the flexibility of and/or compressibility of these components differs. In this respect, in one embodiment of the present invention, the guide components 30*d* and 30*e* are made from a substantially non-compressible material. While not limited in this respect, in one embodiment of the present invention the guide components 30*d* and 30*e* are formed from a substantially incompressible steel coated with plastic, similar to the type of material used to route bicycle cables from the brake handles to the brakes. Of course, it should be appreciated that other incompressible materials can also be employed. In contrast the guide components 30*d* and 30*e*, the other guide components 30*a*–30*c* can be formed from more flexible and compressible material to better conform to the shape of the snowboard boot 28 as the strap 20 is tightened down. Again, while not limited in this respect, the guide components 30*a*–30*c* can be formed from a low-friction high abrasion resistant plastic material.

The effect achieved by forming the guide components 30*d*–30*e* from an incompressible material is that they maintain their shape as the tightening element 24 is tensioned. In this respect, if the guide elements 30*d*–30*e* were compressible, it should be appreciated that when the tightening element 24 was tensioned in response to actuation of the closure device 26, the guide elements 30*d*–30*e* would simply collapse under the tension. In one embodiment of the present invention, it is desirable to route the tightening element 24 from the closure device 26, so that it is constrained to extend substantially in-line with the incompressible guide channels 30*a* and 30*c* at the locations where the tightening element 24 enters those guide channel components (e.g., in the area of the connectors 35*a* and 35*b*). It should be appreciated that this achieved by forming the guide components 30*d*–30*e* from incompressible material, so that these components of the guide 30 will maintain the shape shown in FIG. 1, such that even when tensioned, the tightening element 24 will extend substantially in-line with the guide components 30*a* and 30*c*. By ensuring that the tightening element 24 is in-line with the guide components 30*a* and 30*c*, the embodiment of the present invention shown in FIG. 1 ensures that the configuration of these guide components will not be altered when the tightening element 24 is tensioned.

In the embodiment shown in FIG. 1, the guide components 30*d* and 30*e* are arranged in a criss-cross fashion, such that each routes the tightening element 24 from one side of the closure device 26 to the opposite side of the strap body 22. As a result of this criss-cross pattern, the radius of curvature of the guide components 30*d* and 30*e* is larger than if the tightening element 24 were to take a sharper turn when extending from the closure device 26 to the guide components 30*a* and 30*c*. As a result, less friction is exerted on the tightening element 24 when passing through the guide components 30*d* and 30*e*. Although advantageous, it should be appreciated that the present invention is not limited in this respect, and that the tightening element 24 can be routed from an opening on one side of the closure device 26 to the same side of the strap body 22. Furthermore, alternative designs can also be employed wherein no incompressible components of the guide channel 30 are employed. For example, the mounting position for the closure device 26 can be altered so that its openings 26*a* and 26*b* are substantially in-line with the guide components 30*c* and 30*a*, respectively, thereby achieving the same benefit as provided by the incompressible guide components 30*d* and 30*e*. Furthermore, it should be appreciated that the present invention is not limited to orienting the openings 26*a*–26*b* of the closure device 26 in any particular manner relative to the strap body 22, as numerous orientations are possible. In addition, as discussed below, the closure device 26 need not employ a pair of openings 26*a* and 26*b* for the tightening element 24, as a single opening can alternatively be employed.

As mentioned above, in the embodiment shown in FIG. 1, the strap body 22 includes three lumens (not specifically shown, but represented by the dotted lines in FIG. 1) that receive the guide channels 30*a*–30*c*. The lumens enclose substantially all of the guide channels 30*a*–30*c* except for their ends 32*a*–32*c*. It should be appreciated that the present invention is not limited in this respect, as numerous other configurations are possible. For example, the ends of the guides channels 30*a*–30*c* need not extend beyond the lumens, and can terminate in-line with the lumens. Alternatively, the guide channels 30*a*–30*c* can be attached to the strap body 22 in other ways, rather than being enclosed within a lumen as shown in FIG. 1. For example, the guide channels can simply be affixed to the outer surface of the strap body 22. Furthermore, although the tightening element 24 extends substantially in-line with the longitudinal axis 23 of the strap body 22 in the embodiment shown in FIG. 1, the present invention is not limited in this respect. The tightening element can be routed across the strap body 22 in any of numerous ways, including in routing patterns that zig-zag in directions transverse to the longitudinal axis 23 of the strap body 22, as discussed in more detail below. Furthermore, although the provision of distinct guide channels 30 provides advantages as discussed above, it should be appreciated that the present invention is not limited to their use, as guide elements (e.g., lumens or protrusions) can be provided directly from the material of the strap body 22 itself, rather than employing discrete guide channels. As should be clear fro the foregoing, the present invention is not limited in any respect to the particular manner of routing the tightening element 24 through the strap body 22.

The tightening element 24 can be implemented in any of numerous ways, and the present invention is not limited to any particular implementation. The tightening element 24 should be sufficiently strong to resist the substantial lifting forces that can be encountered when snowboarding, and in this respect may require greater strength than the tightening elements employed in the above-referenced patents relating to rotary closure devices for use on athletic shoes. The tightening element 24 can be formed from a monofilament or a multi-strand line. In accordance with one illustrative embodiment of the invention, the tightening element is formed of a low-friction material capable of resisting a high tensile force without elongation to minimize frictional engagement between the tightening element 24 and the guide 30, and thereby facilitate even pressure distribution along the entirety of the strap body 22 in the manner discussed above. While not limited to any particular material, examples of materials that can be used for the tightening element 24 include various types of plastics or metals, Kevlar® and Spectra Cord®.

In the embodiment shown, the tightening element 24 is formed as a single piece component, with each of the free ends attached to the closure device 26 in a manner that cooperates therewith to enable the tightening element to be drawn into the closure device to tighten the strap 20. As mentioned above, the present invention can employ any of numerous types of closure devices, and is not limited to any particular type of closure device. In one embodiment of the invention, the closure device 26 is a rotary closure device, wherein each of the ends of the tightening element 24 is attached to a spool, such that rotation of the closure device draws both ends of the tightening element 24 into the closure device to wrap around the spool. As mentioned above, in alternative embodiments of the present invention discussed below, the tightening element 24 can alternatively be attached at only one end to the closure device 26.

In the embodiment shown in FIGS. 1–2, a single tightening element 24 and a single closure device 26 are employed. However, the present invention is not limited in this respect, as multiple tightening elements 24 and/or multiple closure devices 26 can be employed. When multiple tightening elements 24 are employed, each can be routed through a different portion of the strap body 20, and the multiple tightening elements 24 can be attached to a single common closure device 26. Alternatively, multiple tightening elements 24 can be employed wherein each is attached to a separate closure device 26.

Figure 3:
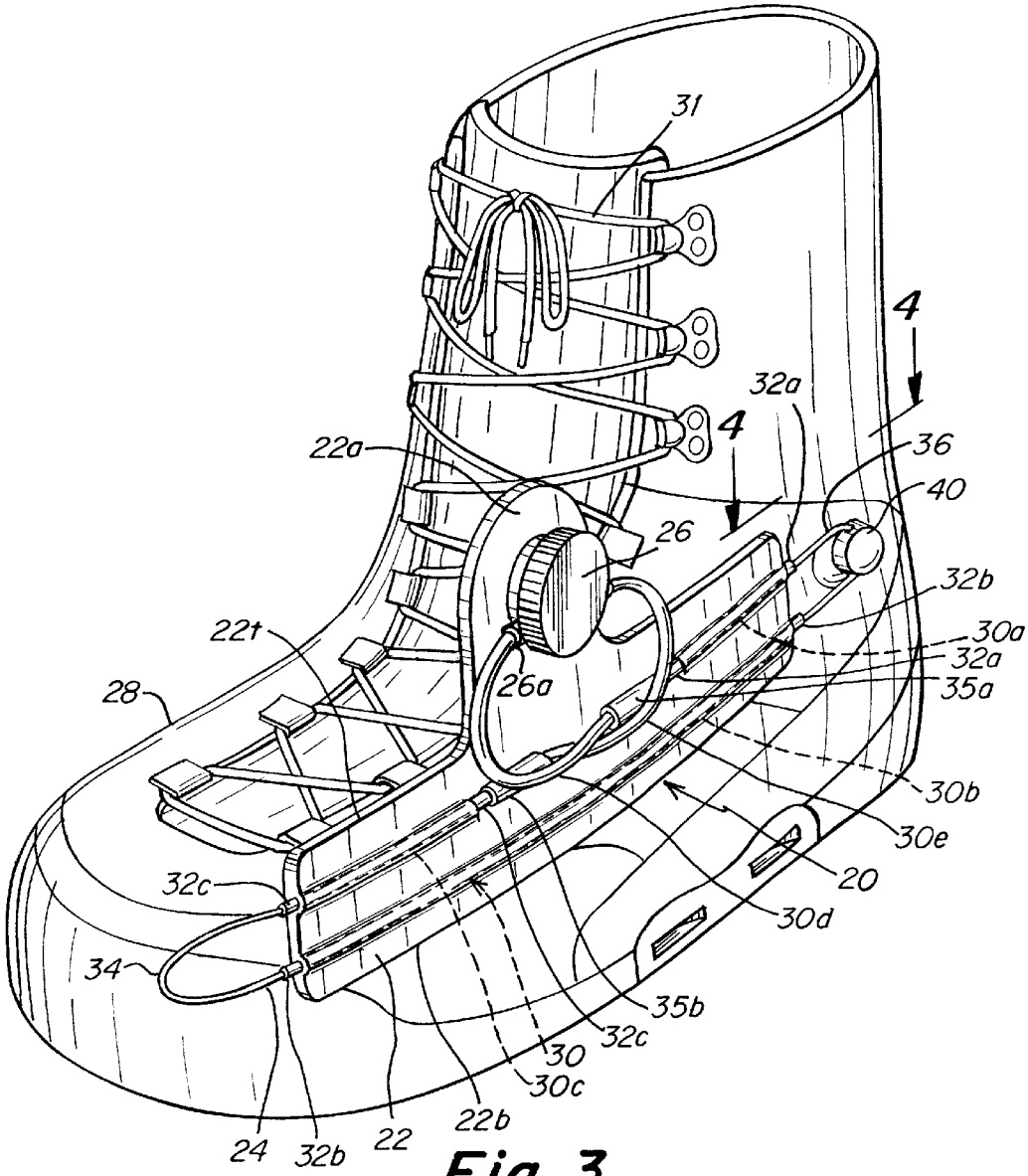
FIG. 3 is a perspective view of the boot securing strap shown in an unsecured position on one side of the boot.
Figure 4:
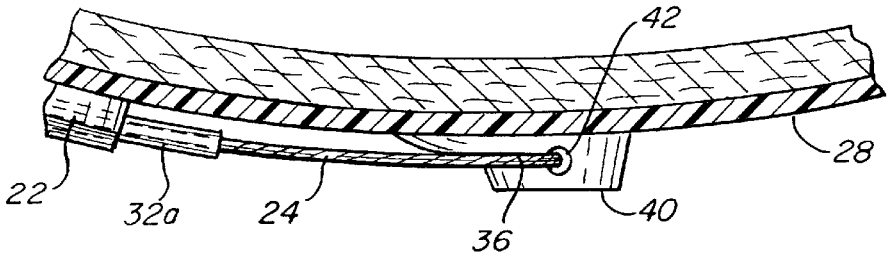
FIG. 4 is a fragmenting cross-sectional view taken along line 4—4 of FIG. 3.

As discussed above, in the embodiment of FIG. 2, the strap 20 can be attached to the snowboard boot 28 by securing the tightening element 24 to two or more anchors 40 disposed on the boot. The anchors 40 (only one of which is shown in FIG. 2) can be implemented in any of numerous ways, and the present invention is not limited to any particular implementation. In this respect, the function performed by the anchors 40 is to enable the tightening element 24 to be routed thereto, and then be redirected by the anchor. For example, in shown in FIG. 2, the anchor 40 redirects the tightening element 24 at the loop end 36, in that the upper portion of the tightening element 24 travels from the closure device 26 out toward the side of the boot, and then is redirected by the anchor 40 back toward the lace area of the boot. The anchors 40 may be formed of any suitable material (e.g., plastic or metal) that is sufficiently strong to withstand the lifting forces exerted on the strap 20. The anchors 40 may be integrally formed into the boot 28, or may be attached thereto using any suitable attachment method, such as stitching, riveting, screwing, heat welding, adhesive bonding, etc. As shown in FIGS. 3 and 4, each anchor 40 may be provided with a lumen 42 through which the tightening element 24 can be threaded to secure the tightening element 24 to the anchor 40. When a lumen 42 is employed, the tightening element 24 will not separate from the anchor, even when significant slack is provided in the tightening element 24. Although the use of a through lumen as the attachment feature on the anchor 40 for mating with the tightening element 24 advantageously provides such secure engagement, it should be appreciated that the present invention is not limited in this respect, and that numerous other types of mating features can be employed. In an alternative embodiment of the present invention, the anchor 40 can include a pulley about which the tightening element 24 is wrapped, to further reduce friction between the anchor 40 and the tightening element 24.

In the embodiment of the invention shown in FIG. 2 wherein the strap 20 is attached in the ankle area of the boot to hold down the heel of the rider, the position at which the anchors 40 are attached to the boot can be as taught in co-pending application Ser. No. 08/619,358, entitled Snowboard Boot and Binding Strap, which is hereby incorporated herein by reference. However, it should be appreciated that the present invention is not limited in this respect, as the strap 20 can alternatively be attached at other locations.

In the embodiment shown in FIGS. 1–2, the snowboard boot 28 is provided with a single strap 20 that is attached at a pair of anchors 40 disposed in the ankle area of the boot, so that the strap is adapted to hold down the rider's heel in the boot. It should be appreciated that the present invention is not limited in this respect, and that a strap embodying the present invention can be attached at other locations on the snowboard boot (e.g., as a toe strap or shin strap), and that a single snowboard boot 28 can employ two or more straps in accordance with the present invention. For example, a strap can be provided to hold down the toe of the rider, one can be attached about the shin area of the snowboard boot 28, and/or a heel strap can be provided. When multiple straps are employed on the snowboard boot 28, each can be provided with its own closure device 26, or a single tightening element 24 can be routed through the multiple straps and can be tightened by a single closure device 26.

Figure 5:
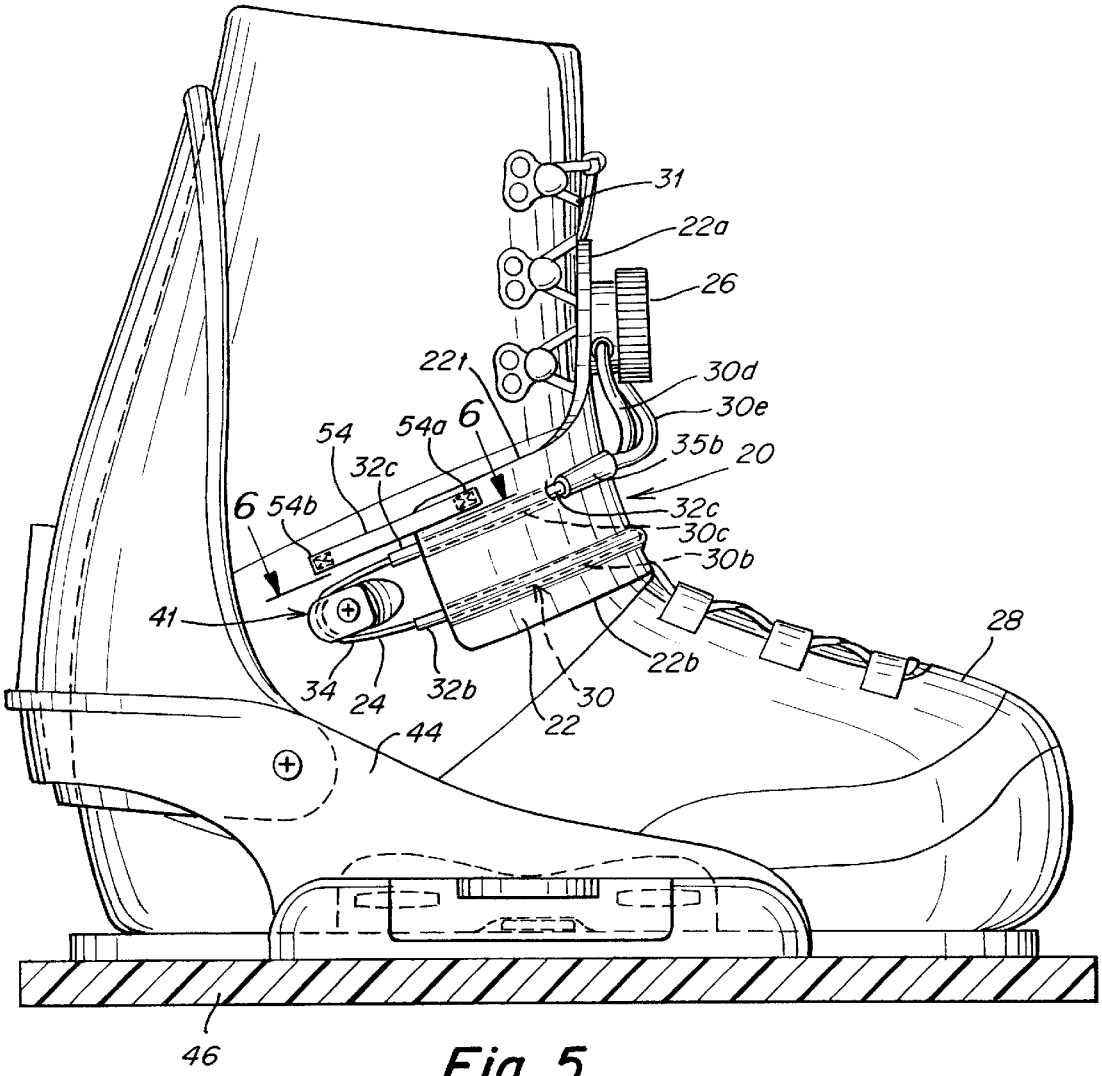
FIG. 5 is a side view of the boot securing strap of FIG. 1 attached to a soft snowboard boot in an alternative manner, and wherein the boot is engaged by a step-in binding.
Figure 6:
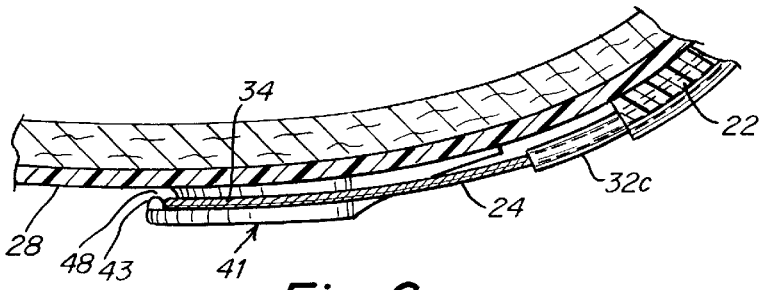
FIG. 6 is a fragmenting cross-sectional view taken along line 6—6 of FIG. 5.

FIGS. 5 and 6 illustrate an alternative anchor 41 for mounting the strap 20 to a snowboard boot 28. In FIG. 5, the snowboard boot is illustrated as being engaged via a step-in binding 44 that is attached to a snowboard 46. The step-in snowboard binding conceptually illustrated in FIG. 5 is that disclosed in co-pending application Ser. No. 08/780,721. However, it should be appreciated that the present invention is not limited to use on a snowboard boot compatible with that particular step-in binding, and can be employed with any type of snowboard boot, including boots compatible with any other type of step-in binding.

FIG. 6 illustrates the construction of anchor 41 for attaching the tightening element 24 to a snowboard boot 28. In the embodiment shown in FIG. 6, the anchor 41 includes a hook 43 that defines an opening 48 to receive the tightening element 24. In contrast with the embodiment shown in FIG. 4, can the rider can engage and disengage the tightening element 24 from the hook, without separating the free ends of the tightening element 24 from the closure device 26, removing the anchor from the boot, or breaking the tightening element or the anchor. This is advantageous for use in accordance with the embodiment of the present invention wherein entry and exit into the snowboard boot 28 is facilitated by detaching one end of the strap 20 from the snowboard boot 28. For use in accordance with this embodiment of the present invention, one end of the strap 20 can be made detachable, while the other end can non-detachably secure the tightening element 24 to the anchor. Examples of detachable and non-detachable anchors are respectively shown in FIGS. 4 and 6. However, it should be appreciated that the aspect of the present invention directed to the use of one detachable connection and one non-detachable connection is not limited to use with the particular anchors 40 and 41 shown in FIGS. 4 and 6, as numerous other implementations for each of the detachable and non-detachable anchors are possible.

In another embodiment of the present invention, each of the anchors attached to the snowboard boot 28 is implemented so that it can detachably release the strap 20. As a result, when the snowboard boot is used with a step-in binding, the strap can be attached thereto. Furthermore, in accordance with the invention recited in co-pending application Ser. No. 08/619,358, entitled Snowboard Boot and Binding Strap, the strap 20 can also be completely removed from the snowboard boot 28 so that the boot can alternatively be employed with a tray binding.

In another embodiment of the present invention (not shown), one end of the tightening element 24 is fixedly attached to the snowboard boot 28, and only a single free end of the tightening element 24 is attached to the closure device 26. The end of the tightening element 24 that is fixed to the snowboard boot 28 can be fixedly attached in any suitable manner, as the present invention is not limited to any particular attachment technique. For example, the tightening element can be looped back upon itself to create a noose-type loop that can be wrapped around a post or other element fixed to the snowboard boot 28, an eyelet can be attached to the free end of the tightening element 24 which can be secured to a hook or screw on the snowboard boot or, a hook or other mating feature can be attached to the free end of the tightening element 24 and can be mateable with a corresponding mating feature fixed to the snowboard boot 28. In the embodiment wherein one end of the tightening element 24 is fixed to the snowboard boot 28, the remainder of the tightening element 24 can be routed through the strap body 22 in much the same manner as discussed above, to traverse a sufficient portion of the strap body 22 to tighten the strap down over the top of the snowboard boot 28. The tightening element 24 can be attached at the other side of the boot using any of the anchoring schemes discussed above.

In a further alternative embodiment (not shown), separate tightening elements 24 can be employed to attach each side of the strap 20 to a corresponding side of the snowboard boot 28. For example, two tightening elements 24 can be employed, each with a free end attached to the closure device 26 and a fixed end fixedly attached to one side of the snowboard boot in much the same manner as discussed above. Each tightening element 24 can be attached to the same closure device 26, each tightening element 24 can alternatively be attached to a separate closure device 26.

Figure 7:
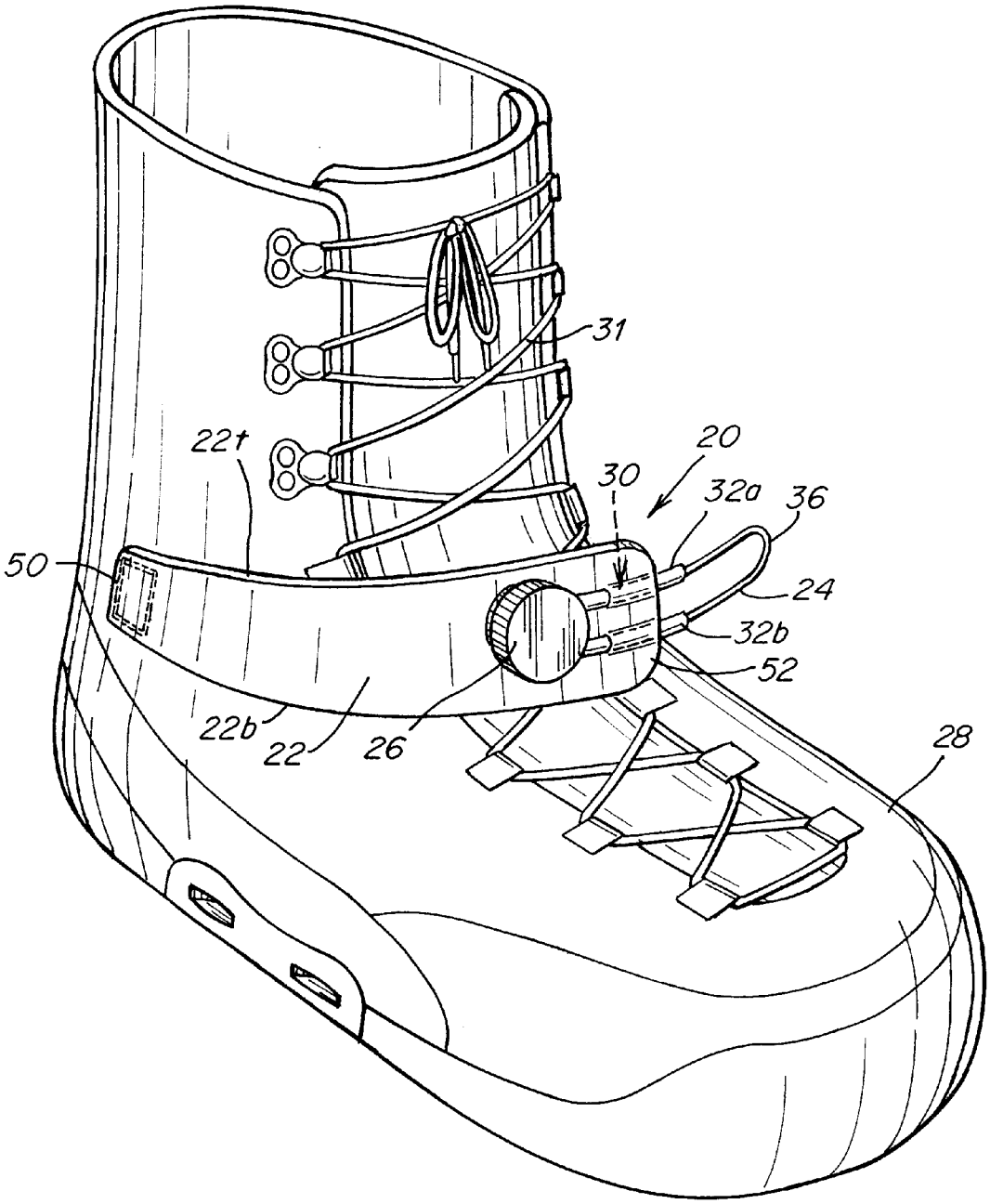
FIG. 7 is an alternative embodiment of the boot securing strap attached to a soft snowboard boot in an alternative manner on one side of the boot, and being in an unsecured position on the other side of the boot.

In a further alternative embodiment of the invention shown in FIG. 7, the strap 20 is fixedly secured at one end 50 directly to the boot, and the tightening element 24 is employed only to connect a second end 52 of the strap 20 to the snowboard boot. The end 50 of the strap 20 can be fixedly attached to the boot in any of numerous ways (e.g., by stitching, riveting, screwing, adhesive bonding, etc.), as the present invention is not limited to any attachment technique. In accordance with one embodiment of the present invention, an attachment technique is employed that enables the end 50 of the strap 22 to be removed from the snowboard boot in accordance with the teachings of co-pending application Ser. No. 08/619,358.

In the embodiment shown in FIG. 7, both ends of the tightening element 24 are secured to the closure device 26, with the tightening element forming a loop end 36 that is attachable to an anchor (not shown) on the snowboard boot in any of the ways discussed above in connection with the earlier-described embodiments of the invention. Alternatively, only a single end of the tightening element 24 can be attached to the closure device 26, with the other end being attached to the anchor on the boot as described above. The tightening element 24 can be of sufficient length so that the strap can be loosened sufficiently to enable the rider to get his or her foot into and out of the snowboard boot 28, and/or the tightening element can be made detachable from the boot 28 to facilitate entry and exit from the boot as discussed above.

In the embodiments of the present invention shown in FIGS. 1–7, the closure device 26 is mounted to the strap body 22. The present invention is not limited to any particular mounting location for the closure device 26 on the strap body 20, as numerous locations can be employed. As discussed above, the closure device 26 can be disposed substantially in-line with the routing pattern for the tightening element 24 (as shown in FIG. 7), or the openings (26*a*–26*b* in FIG. 1) of the closure device 26 can be disposed away from the primary path of the tightening element 24 as shown in FIGS. 1–2. In the embodiment of the invention shown in FIG. 1, the closure device is disposed away (above in FIG. 1) from the plane in which the tightening element 24 will primarily distribute pressure through the strap body 22. As a result, when the strap is tightened down atop the boot, the closure device 26 will not bear down on the snowboard boot 28, and therefore will not create an uncomfortable pressure point. Although advantageous, it should be appreciated that the present invention is not limited in this respect, and that the closure device can alternatively be disposed more in-line with the tightening plane of the strap 20 as shown in FIG. 7.

The closure device 26 can be mounted to the strap body 22 in any of numerous of ways, as the present invention is not limited to any particular mounting technique. In one embodiment of the invention, the closure device 26 is preferably mounted to the strap body 22 in a manner that is detachable by the rider, so that if there is a malfunction of the closure device 26 or if the tightening element 24 breaks, the entire system including the tightening element 24 and closure device 26 can simply be removed and replaced by the rider. In one embodiment of the invention, a substantially rigid pressure distribution plate (not shown) can be mounted to the strap body 22 (e.g., by stitching, by using a screw and T-nut, adhesive bonding, etc.). The pressure distribution plate provides some rigidity to withstand the forces exerted on the tightening element 24 while riding, and can be provided with a mating feature that mates with a corresponding feature on the closure device 26 to allow the closure device to be detachably secured to the pressure distribution plate. Alternatively, the closure device 26 can be mounted to the strap body 26 in such a way that forces exerted thereon by the tightening element 24 cancel each other out (e.g., forces pulling toward the medial side of the boot balance those pulling toward the lateral side of the boot), such that the pressure distribution plate is unnecessary. In this embodiment, the attachment of the closure device 26 to the strap body 22 need not be as secure. For example, the closure device 26 can simply be stitched into the strap body 22. Alternatively, the closure device 26 need not be attached at all.

Figure 8:
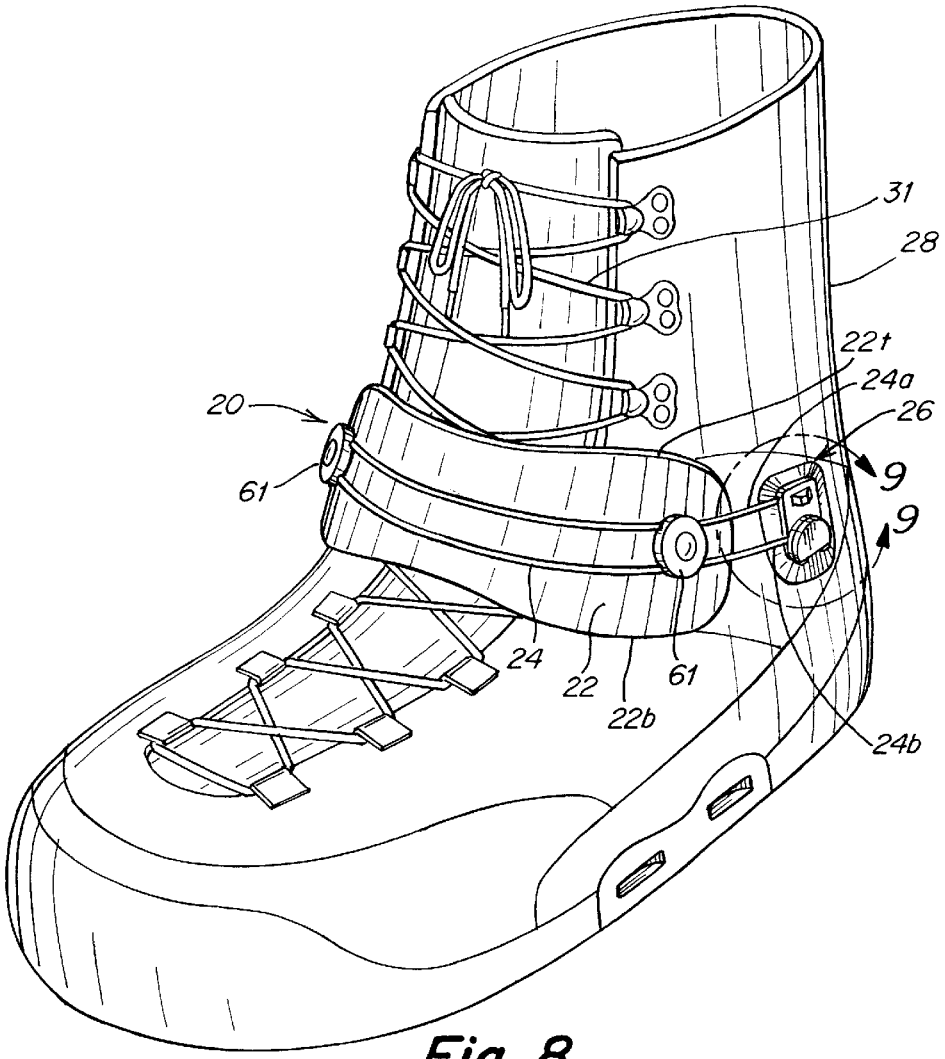
FIG. 8 is another alternative embodiment of the boot securing strap attached to a soft snowboard boot in a different manner.

The closure device 26 need not be mounted to the strap body 22, but rather, can be mounted directly to the snowboard boot for each of the embodiments of the present invention discussed above. An illustrative example of an embodiment of the present invention wherein the closure device 26 is mounted directly to the snowboard boot 28 is shown in FIG. 8. As shown therein, the tightening element 24 is attached at one end 24*b* to the closure device 26, and extends over the strap body 22 to the other side of the boot, wherein it is secured via an anchor (not shown), and then returns back over the strap body 22 so that its other end 24*a* is at the same side of the boot as the closure device 26. Rather than being attached directly to the boot, the end 24*a* of the tightening element can also be attached to the closure device 26, in the manner discussed above. In the embodiment shown in FIG. 8, the end 24*a* of the tightening element is attached (either fixedly or detachably) directly to the snowboard boot 28 using any of the numerous techniques discussed above.

As with the embodiments discussed above, the anchor that attaches the tightening element 24 to the opposite of the snowboard boot 28 can be implemented in any of numerous ways, as the present invention is not limited to any particular implementation technique. Like with the embodiments discussed above, the connection between the tightening element 24 and the anchor on the opposite side of the boot can be made detachable, to facilitate entry and exit from the snowboard boot 28, or the attachment can be made non-detachable, such that entry and exit from the snowboard boot 28 is accomplished by achieving sufficient slack in the tightening element 24 to loosen the strap 20. Similarly, the tightening element 24 can be routed over the strap body 22 in any of numerous ways. For example, the strap body 20 can be provided with one or more guide channels similar to guide channels 30*a*–30*c* discussed above in connection with the embodiment of FIG. 1. Alternatively, the strap body can be provided with two or more attachment elements 61 that are mounted to the strap body 22 and attach the tightening element 24 thereto. The attachment elements 61 can be implemented in any of numerous ways, as the present invention is not limited to any particular implementation. For example, the attachment elements 61 can be provided with one or more through lumens (not shown) to receive the tightening element 24 in much the same manner as the lumens 42 provided in the anchor 40 illustrated in FIG. 4. The attachment elements 61 can be attached to the strap body 22 in any of numerous ways (e.g., via riveting, screwing, stitching, adhesive bonding, etc.). As shown in the embodiment of FIG. 8, when two or more attachment elements 61 are employed, the tightening element 24 can simply overlie the strap body 22 rather than passing through a portion thereof as is the case when guide elements such as those shown in FIG. 1 are employed. In one embodiment of the invention, when the tightening element 24 is adapted to overlie the strap body 22, the surface of the strap body 22 that underlies the tightening element 24 can be formed from a low-friction material to facilitate sliding of the tightening element 24 over the strap body 22.

As mentioned above, the present invention is not limited to the particular routing patterns of the tightening element 24 shown in FIGS. 1–8. In this respect, in each of the embodiments shown, the tightening element 24 is generally guided through the strap body 22 in a direction that is substantially parallel to a length axis 23 (FIG. 1) of the strap body 22. However, the invention is not limited in this respect, as numerous other routing patterns are possible. For example, the tightening element 24 can be routed across (e.g., either through, atop, below or a combination thereof) the strap body 22 in a zigzag pattern wherein the tightening element travels toward a top surface 22t (FIG. 1) of the strap body 22 over part of its length, and toward a bottom surface 22*b* (FIG. 1) of the strap body 22 along other portions of its length. When routed in ways that require a change in direction for a portion of the tightening element 24 passing across the strap body 22, routing features such as the attachment elements 61 shown in FIG. 8 can be employed to assist in guiding the change in direction, or guide channels such as 30*a*–30*c* shown in FIG. 1 can be provided that are shaped to provide the desired change in direction and formed from an incompressible material. It should be appreciated that in addition to zigzag patterns, numerous other routing patterns for the tightening element 24 are possible, as the present invention is not limited to any particular routing pattern.

It should be appreciated that each of the embodiments of the present invention relating to detachably or non-detachably securing the tightening element 24 to the snowboard boot has certain advantages. In this respect, for the embodiment of the invention wherein the tightening element 24 is detachably secured to the snowboard boot 28, the strap can be completely removed from the snowboard boot, to make it compatible with a tray binding. In addition, since the tightening element 24 need not be long enough to enable the strap to be loosened enough to facilitate entry and exit from the boot, the closure device 26 can potentially be made smaller, as it need not house as great a length of the tightening element 24. However, in one embodiment of the invention wherein at least one end of the strap is detachably secured to the boot, sufficient length of tightening element 24 is provided to enable some slack to be experienced therein, so that the rider can adjust the position of the strap body 22 over his or her foot by sliding the strap body 22 relative to the tightening element 24.

In a further alternative embodiment, shown in FIG. 5, the strap 20 may also include a registering feature, which is used to register or locate the strap 20 on the boot in a desired medial, centered or lateral position. The registering feature can be implemented in any of numerous ways and the present invention is not limited to any particular implementation. In the embodiment shown in FIG. 5, the registering feature is formed as a non-stretchable strip 54 that is attached (e.g., stitched) at one end 54*a* to the strap body 22 and at the other end 54*b* to the boot upper. The non-stretchable strip limits the extent of movement of the strap 20 in the direction away from the end 54*b* attached to the boot. The strip 54 may be provided with any suitable adjustment means to adjust the length of the strip 54. For example, the strip 54 may be provided with a buckle, such as a ladder-lock buckle, to adjust the length of the strip 54. In this regard, the length of the strip 54 may be infinitely incrementally adjustable along at least a part of its length. Thus, a rider may adjust the length of the strip such that when the strip is fully extended, the strap 20 is registered in a desired position relative to the boot 28. The rider may then tighten the strap 20 against the boot in order to secure the strap 20 in the desired position.

Although in the example described with reference to FIG. 5 the strip 54 is stitched to the strap 20 at one end and to the boot at the other end, any suitable fastening means may be used in place of the stitching. For example, a snap fastener or a hook and loop fastener may be used at one end of the strip 54. In this regard, the fastener selected may provide the adjustability in the length of the strip 54 such that a separate adjustment mechanism is not required.

In another embodiment (not shown), the registering feature may be provided by providing mating features directly on the strap 20 and the boot 28. For example, a hook and loop fastener may be disposed between the strap 20 and the boot 28 such that the strap 20 may be registered in a desired position on the boot. Alternatively, cooperating halves of a plurality of snap fasteners may be used to register the strap 20 directly to the boot 28. Once the strap is registered in the desired position, the closure device 26 can be actuated to tighten the tightening element 24 to firmly secure the strap 20 to the boot 28 in the desired position.

Figure 9:
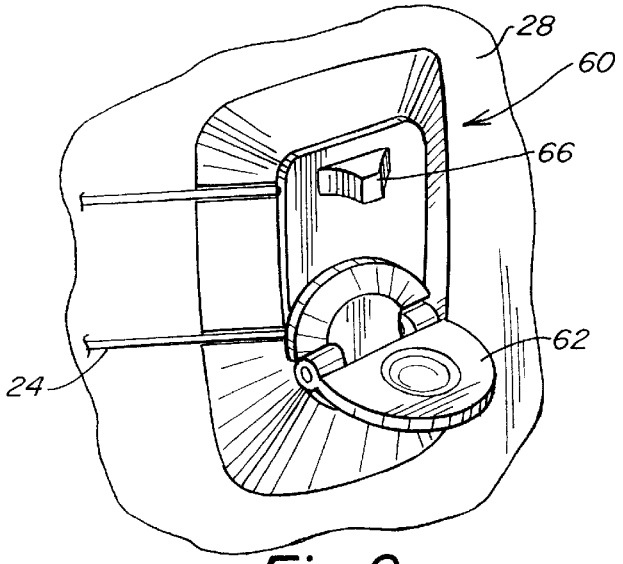
FIG. 9 is an enlarged view of area encircled by arrows 9—9 of FIG. 8 showing a closure device for the boot securing strap of FIG. 8.

In the embodiment shown in FIG. 8, the closure device 26 is mounted to the outside of the snowboard boot. However, it should be appreciated that the embodiment of the present invention wherein the closure device 26 is mounted to the snowboard boot is not limited in this respect, as the closure device can be mounted to numerous other locations on the snowboard boot, such as on the inside of the boot, or the tongue or behind the heel. In the embodiment shown in FIG. 8, wherein the closure device 26 is mounted to the side of the snowboard boot, it should be appreciated that it is desirable to employ a closure device 26 that has a relatively low profile, so that it does not extend a significant distance from the side of the snowboard boot 28. Such a closure device is shown in FIG. 9. As the present invention is not limited to any particular type of closure mechanism, the details of the closure device 60 are not described herein. The closure device 60 includes a knob 62 that can flip from a down position to an extended position shown in FIG. 9 to facilitate grabbing by the rider. When in the extended position of FIG. 9, rotation of the knob 62 can cause an incremental tightening of the tightening element 24 in much the same manner as with conventional rotary closure mechanisms. Advantageously, when not needed for actuation, the knob 62 can be flipped down to the non-use position in which it lies substantially flush with the side of the boot to reduce the profile of the closure device 60. This type of closure mechanism is known in the art of bike shoes. The closure device 60 may also optionally include a release button 66, which, when actuated, releases the tightening element 24.

In each of FIGS. 2–3, 5 and 7–8 which shows a strap according to the present invention mounted to a snowboard boot, the snowboard boot is shown as a soft snowboard boot having a pair of laces 31 that close the front of the boot. Although the strap of the present invention provides a number of advantages when used in connection with such a boot as described above, it should be appreciated that the present invention is not limited in this respect and that the various embodiments of a strap in accordance with the present invention can be provided on other types of snowboard boots. For example, the various embodiments of the present invention can be used in connection with any soft snowboard boot, regardless of the closure system used to close the boot, as various other types of closure systems (e.g., buckles) can be employed rather than a pair of laces 31. In addition, the various embodiments of a strap according to the present invention can also be used with a hard snowboard boot or a hybrid snowboard boot.

In the embodiments of the present invention discussed above, the strap 20 includes a strap body 22 that, among other functions, serves to distribute pressure exerted on the snowboard boot 28 via the tightening element 24. In this respect, it should be appreciated that the strap 20 could be formed with the tightening element 24 directly overlying the surface of the boot 28, and with the closure device 26 being mounted elsewhere. However, when the relatively thin tightening element 24 is tensioned, it could create uncomfortable pressure points on the boot 28. Thus, one function served by the strap body 22 is to distribute the pressure created via the tightening element 24 across a greater surface area. This pressure distribution function is enhanced when the strap body 22 is provided with padding to increase the comfort of the strap 20 on the snowboard boot 28.

Figure 13:
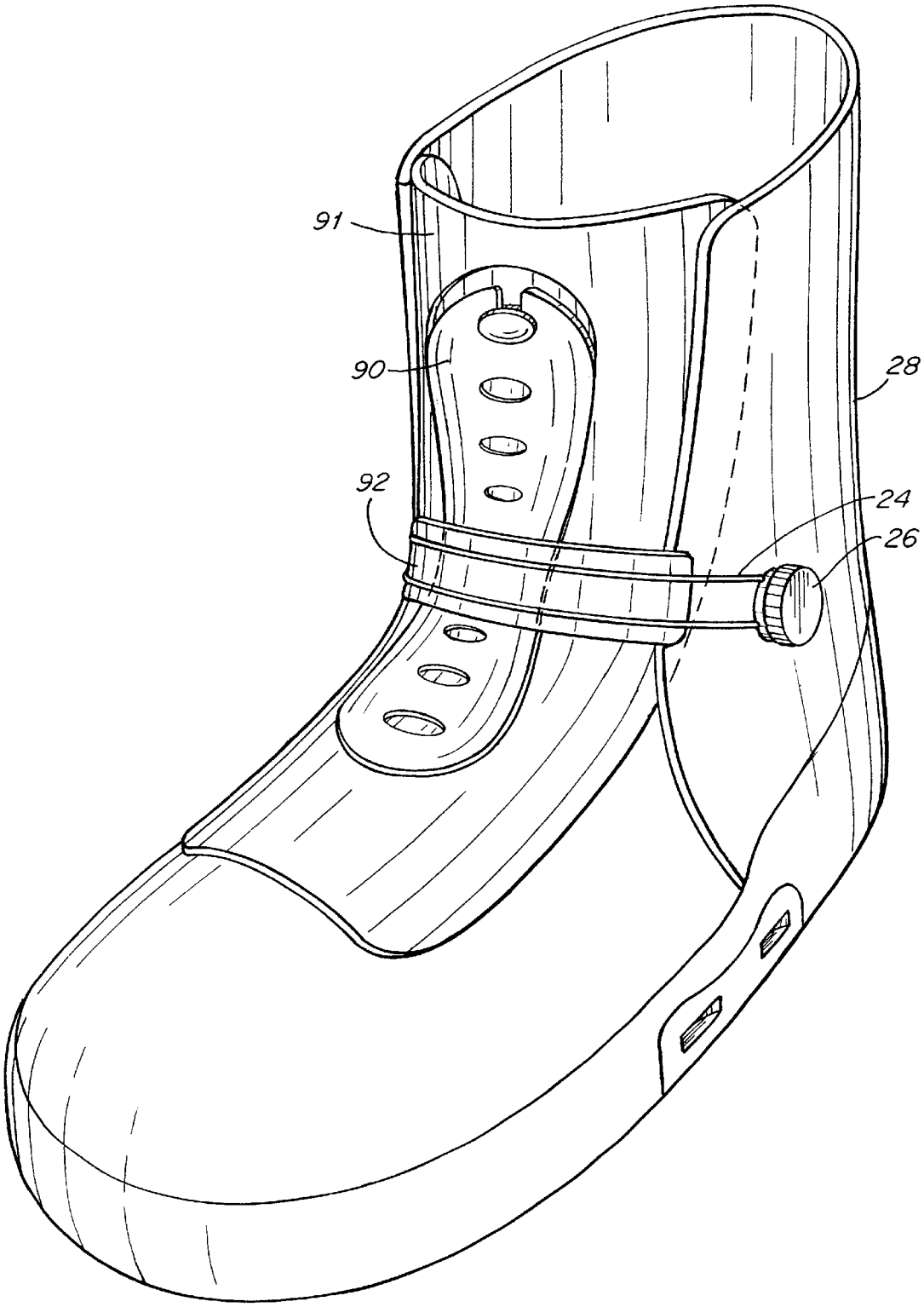
FIGS. 13–15 are perspective views showing alternative views of a tongue stiffener for use with the present invention.
Figure 14:
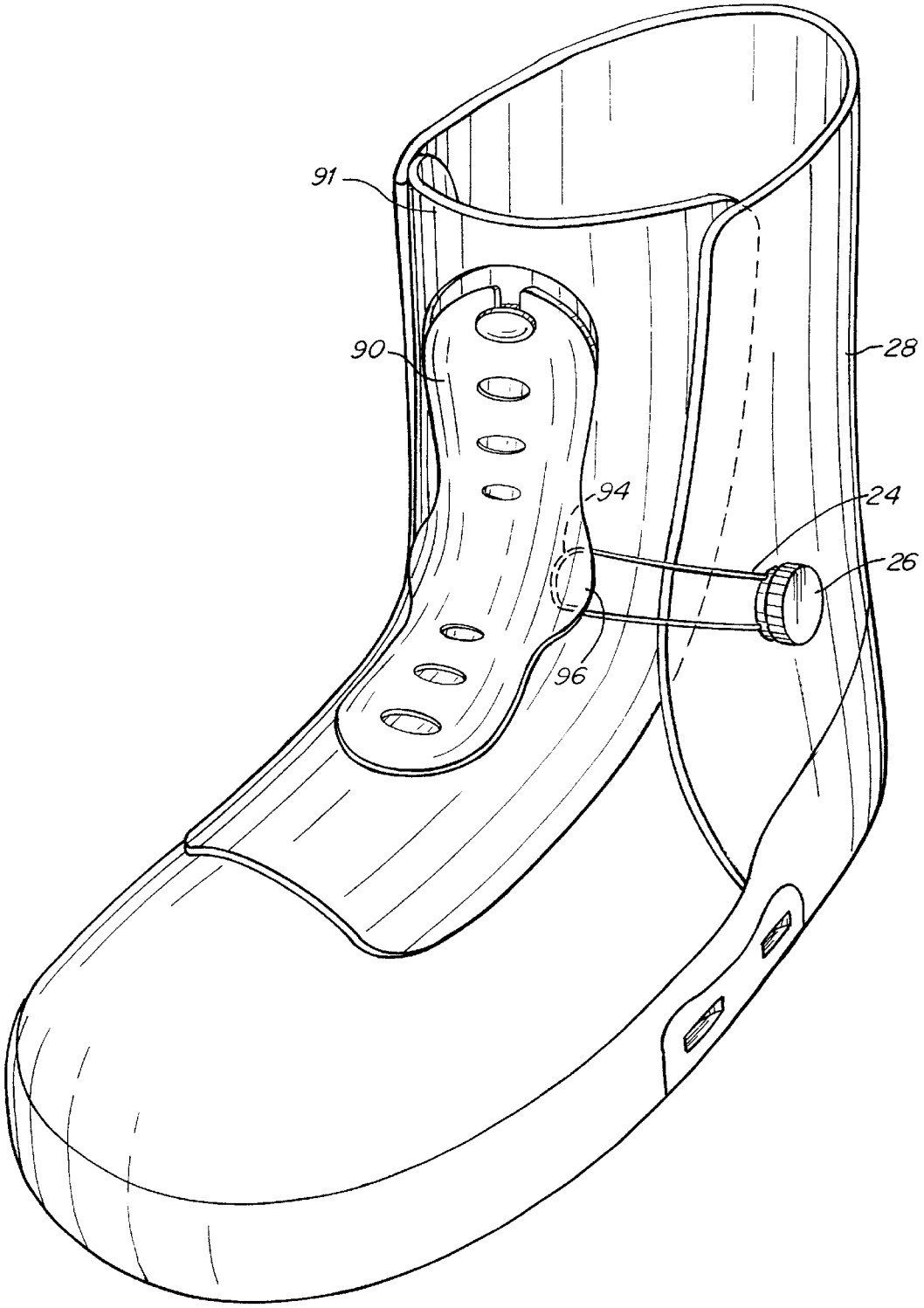
Figure 15:
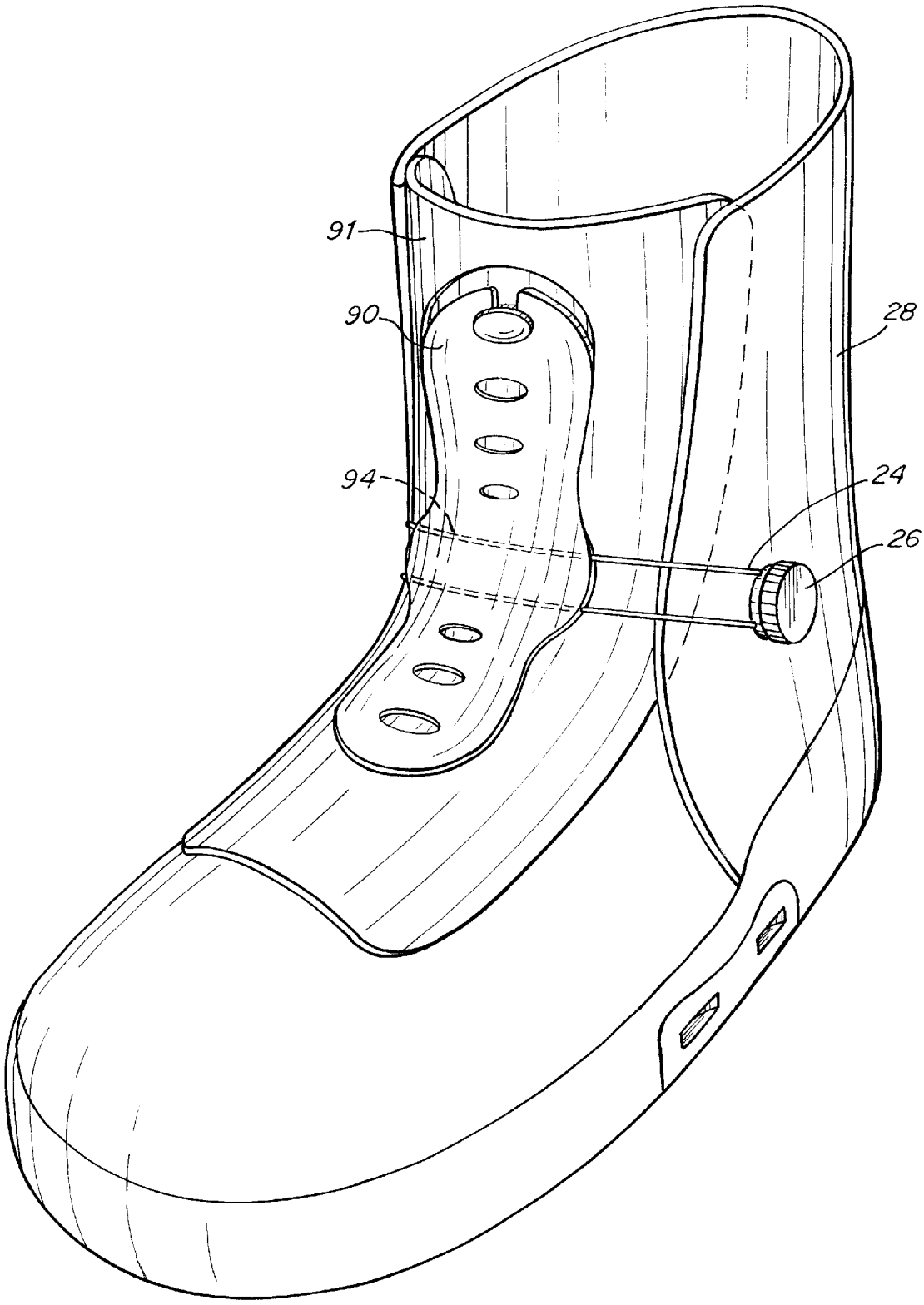

In an alternate embodiment of the present invention shown in FIGS. 13–15, the snowboard boot 28 can itself be provided with a pressure distribution element to distribute pressure exerted thereon via the tightening element 24. An example of such a pressure distribution element is the tongue stiffener 90 shown in FIGS. 13–15. An example of such a tongue stiffener is described in co-pending U.S. provisional application Ser. No. 60/111,309, which is incorporated herein by reference. As shown in FIG. 13, the tongue stiffener is mounted to the tongue 91 of the snowboard boot 28. The purpose of the tongue stiffener 90 is to cooperate with the tongue 91 to increase resistance of the boot to forward bending. In the view shown in FIG. 13, portions of the boot upper, including the laces 31, have been removed for the sake of clarity.

The tongue stiffener 90 can be formed from any rigid material (e.g., plastic). In addition to stiffening the tongue, a substantially rigid tongue stiffener 91 will also distribute pressure exerted thereon via the tightening element 24. As a result, in one embodiment of the present invention, the strap can be modified to employ a substantially reduced strap body 92, as the strap body 92 need not perform any pressure distribution function. As a result, a minimal strap body 92 can be employed which includes no padding, but merely provides a guide for routing the tightening element 24 from one side of the boot to the other. Alternatively, the strap body 92 can be even further minimized, such that it includes two discrete guide channels for guiding the upper and lower portions of the tightening element 24 that extend between the two sides of the snowboard boot 28. Furthermore, it is also possible to eliminate the strap body 92 altogether, such that the tightening element 24 is exposed as it extends between the two sides of the snowboard boot 28.

As shown in the embodiment of FIG. 13, when the strap body 92 is minimized, it may not be sufficiently supportive to mount the closure device thereto. Therefore, in accordance with the embodiments of the present invention wherein either a minimal or no strap body is provided, the closure device 26 can be mounted to the pressure distribution element (e.g., tongue stiffener 90), the tongue 91, or to some other portion of the boot as shown in FIG. 13.

It should be appreciated that the pressure distribution element can be formed in any of numerous ways, and is not limited to having the configuration of the tongue stiffener 90 illustrated in FIG. 13. In this respect, the pressure distribution element can be disposed only in the area crossed via the tightening element 24, and need not extend significantly above or below that area in the manner that the tongue stiffener 90 does in FIG. 13. In addition, the pressure distribution element can be formed of any suitable material capable of sufficiently distributing the pressure exerted thereon via the tightening element 24. Furthermore, in the embodiment shown in FIG. 13, the tongue stiffener is shown mounted to the outer surface of the tongue 91. It should be appreciated that rather than being mounted to the tongue, the pressure distribution element can be incorporated into the structure of the tongue 91. Finally, while the pressure distribution element has been described herein as being useful with a nonpadded strap, it should be understood that the pressure distribution element can also be used in conjunction with a padded strap.

As with the embodiment discussed above in connection with FIG. 7, the embodiment of the present invention directed to the use of a pressure distribution element can also be employed with the tightening element 24 being only routed to one side of the snowboard boot. In this respect, in the embodiment shown in FIG. 14, a guide 94 is formed in a wing 96 of the tongue stiffener 90 and receives the tightening element 24. Therefore, when the closure device 26 is actuated to draw in the tightening element 24, the tongue stiffener 94 is tightened down atop the tongue 91 to secure the rider's foot in the boot 28. It should be appreciated that the guide 94 can be disposed through the tongue stiffener 90, or a separate routing element for the tightening element 24 can be mounted to the tongue stiffener 90. It should further be appreciated that a separate closure device 26 and tightening element 24 can be attached to the opposite side of the tongue stiffener 90 to work in the same manner, or alternatively, the opposite side of the tongue stiffener 90 can be fixedly secured to the tongue 91 so that the tongue stiffener 90 is not displaced when the tightening element 24 is tensioned.

In a further embodiment of the invention shown in FIG. 15, the strap is formed without a strap body, and is routed through (rather than over as in FIG. 13) the pressure distribution element (e.g., the tongue stiffener 90) from one side of the snowboard boot 28 to the other. In this respect, the tongue stiffener 90 includes a pair of guide channels 94 through which the tightening element 24 is routed. In the embodiment shown in FIG. 15, the closure device is mounted on one side of the boot 28. Of course, as described above, the closure device 26 can alternatively be mounted directly to the tongue stiffener 90 or to the tongue 91.

Figure 10:
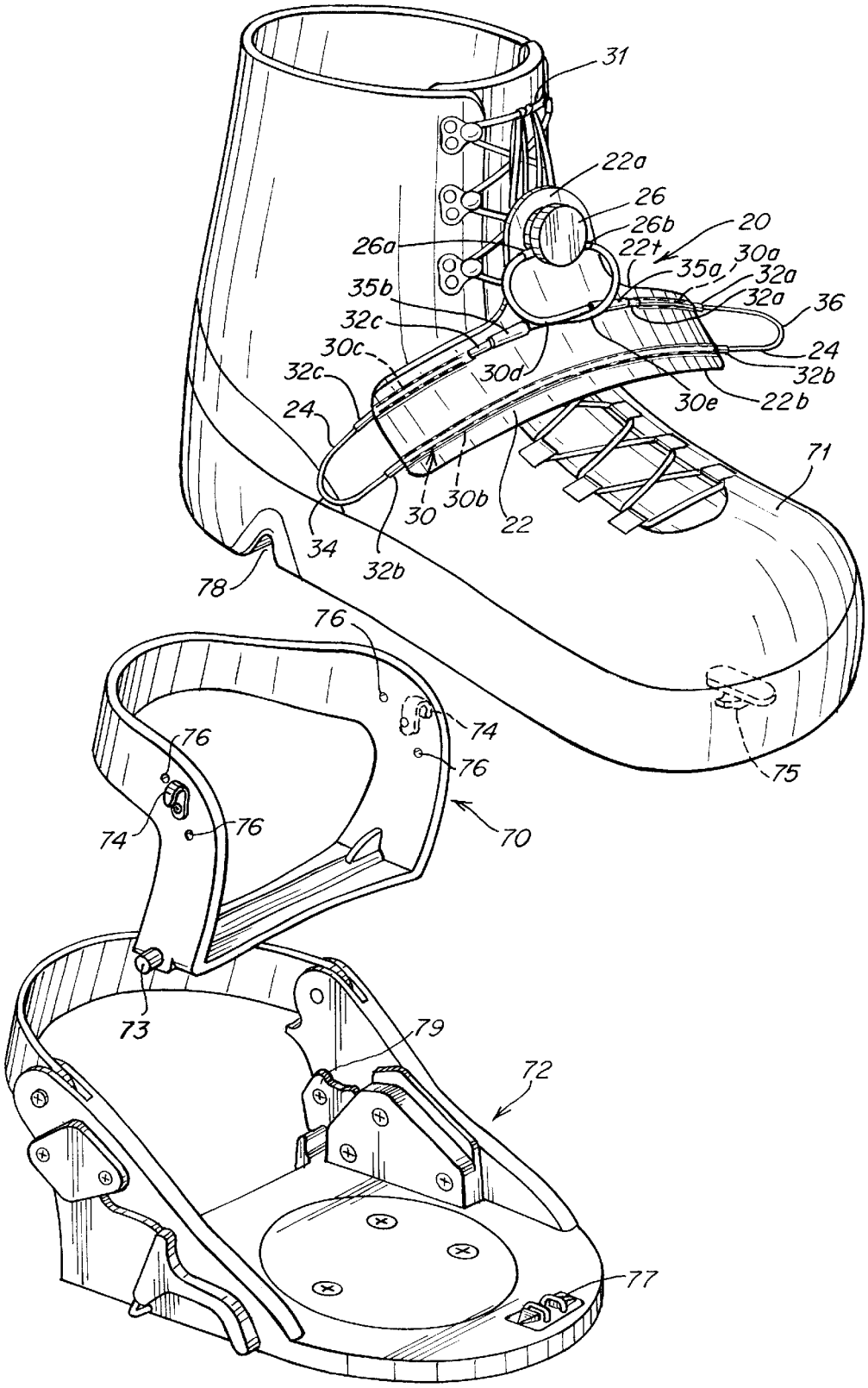
FIGS. 10 and 11 are exploded perspective views showing a boot securing strap according to the present invention for use in attaching a binding interface to a snowboard boot.
Figure 11:
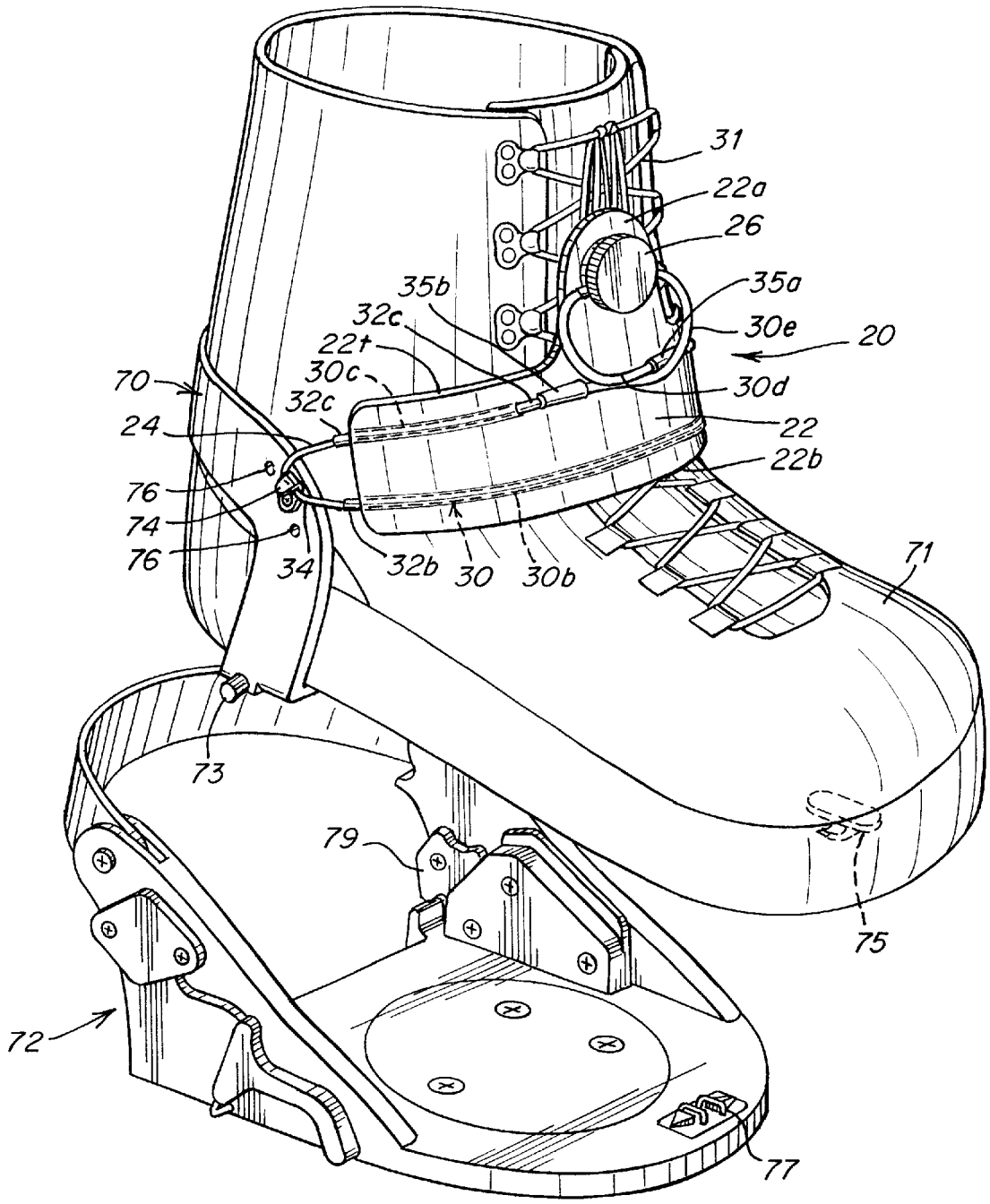

In another illustrative embodiment of the present invention shown in FIGS. 10–11, the strap 20 is employed with a binding interface 70 to mount a snowboard boot 71 thereto. The binding interface 70 includes a pair of mating features 73 (only one of which is shown in FIGS. 10–11) for mating with a step-in binding 72 to releasably secure the binding interface 70 thereto. In the particular embodiment shown in FIGS. 10–11, the step-in binding 72 and the binding interface 70 are implemented as described in co-pending application Ser. No. 09/062,143, entitled Snowboard Binding, which is hereby incorporated herein by reference. 24 As disclosed in that related application, the step-in binding 72 includes a pair of movable engagement members 79 (only one of which is shown in FIG. 10) for mating with the mating feature 73 on the binding interface, and further includes a mating feature 77 adapted to mate with a corresponding mating feature 75 at the toe end of the snowboard boot. The snowboard boot 71 includes a recess 81 for receiving the binding interface 70. The toe end of the snowboard boot 71 is directly engaged to the binding 72 via the mating feature 75, while the heel end of the snowboard boot is engaged to the binding via the engagement between the snowboard boot 71 and the interface 70. In this respect, the binding interface 70 is engaged by the step-in binding 72, whereas the heel of the snowboard boot 71 is held in engagement with the binding interface 70 via the strap 20.

The strap 20 according to the embodiment of the invention shown in FIGS. 10–11 performs a similar function to that described in the embodiments of FIGS. 2–9, wherein the strap is attached directly to the snowboard boot. In this respect, the strap 20 holds the heel of the rider down in the snowboard boot 71. However, the strap 20 in the embodiment of FIGS. 10–11 also performs the function of attaching the heel of the snowboard boot to the binding interface 70, and through the interface 70, to the step-in binding 72. It should be appreciated that the aspect of the present invention directed to the use of a strap for a snowboard binding interface is not limited to the particular interface and step-in binding system disclosed in FIGS. 10–11, as it can be employed with any snowboard binding interface, including one that has a different configuration and mates with a different type of snowboard binding.

It should be appreciated that all of the discussions above concerning the various embodiments and configurations of the strap 20 are equally applicable to the embodiment of the present invention wherein the strap is employed on a snowboard binding interface.

For example, the snowboard binding interface 70 can be provided with a pair of anchors 74 for securing the strap 20 to the interface. The anchors 74 can be adapted to engage the tightening element 24 on both sides of the binding interface, or the strap body 22 can be fixed to one side of the binding interface as discussed above in connection with the embodiment of FIG. 7. Each of the anchors 74 can be adapted to fixedly secure the strap 20 to the binding interface, such that the rider can step into the binding interface by actuating the closure device 26 to release sufficient slack in the tightening element 24 to allow the boot to be stepped into the binding interface 70. Alternatively, the tightening element 24 can be fixedly attached at one end to the binding interface 70, and can be detachably secured at the other, so that the rider can simply detach one end of the strap 20 from the binding interface 70 to get into or out of engagement with the binding interface 70 in a manner similar to that described above. Furthermore, multiple straps 20 can be employed to mount the snowboard boot 71 to the binding interface 70, and each of the straps can employ any of the numerous configurations discussed above.

As shown in FIGS. 10–11, the binding interface 70 can be provided with a plurality of holes or other mounting positions 76 so that the attachment location of the anchors 74 can be adjusted to suit the rider's preference.

Figure 12:
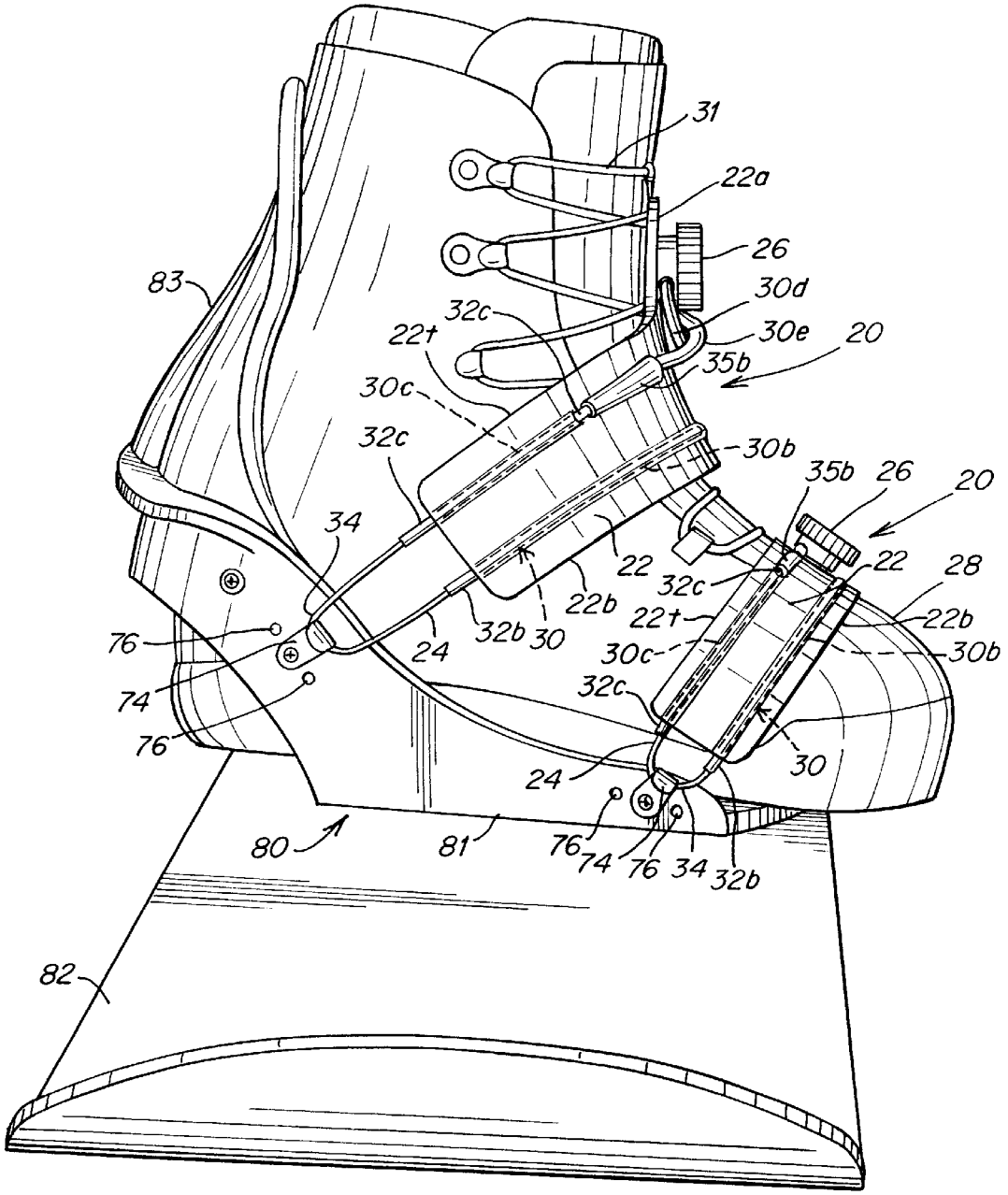
FIG. 12 is a side view showing a pair of boot securing straps according to the present invention on a tray binding for securing a snowboard boot to the tray binding.

In another illustrative embodiment, the ankle strap 20 according to the present invention can be employed to attach the snowboard boot directly to a binding such as a tray binding 80 attached in a snowboard 82, as shown in FIG. 12. As shown in FIG. 12, the tray binding 80 includes a highback 83, as well as multiple straps 20 that are used to attach the snowboard boot 28 to the binding 80. Although not shown, an additional strap may be used to secure the shin area of the boot to the upper portion of the highback. It should be appreciated that the present invention is not limited to use with a binding that includes a highback 83, nor one that includes any particular number of straps. In addition, it is contemplated that a snowboard binding can be provided with a strap according to the teachings of the present invention, along with one or more conventional straps. For example, a tray binding can be employed with the heel strap being implemented in accordance with the teachings of the present invention, while the toe strap is a conventional ratchet-type strap.

It should be appreciated that all of the aspects of the present invention discussed above in connection with a strap on a snowboard boot can also be employed in the embodiment of the invention wherein the strap is attached to a snowboard binding. In the embodiment shown in FIG. 12, the snowboard binding 80 includes a base 81 having a plurality of anchors 74 attached thereto for securing the tightening elements 24 of the straps 20. As shown in FIG. 12, the base can include multiple holes 76 for receiving the anchors 74 in multiple mounting positions.

Having thus described certain embodiments of the present invention, various alterations, modifications, and improvements will readily occur to those skilled in the art. Such alterations, modification, and improvements are intended to be within the spirit and scope of the invention. Accordingly, the foregoing description is by way of example only, and not intended to be limited. The invention is limited only as defined in the following claims and the equivalents thereof.

What is claimed is:

1. An apparatus, comprising:

a snowboard boot binding interface for interfacing a snowboard boot to a snowboard binding, the interface having opposed anchors; and a strap, supported by the interface, to hold the interface to the snowboard boot, the strap comprising:

a tightening element attached to the interface, the tightening element having opposed end portions engageable with the anchors;

a strap body supported by the tightening element; and a closure device supported by the interface, the closure device comprising a housing and a spool rotatably mounted relative to the housing, the tightening element being wrapped around the spool, wherein the tightening element is movable relative to the strap body as the closure device tightens the tightening element to secure the interface to the boot.

2. The apparatus of claim 1, wherein the closure device is mounted to the strap body.

3. The apparatus of claim 1, wherein the closure device is mounted directly to the interface.

4. The apparatus of claim 1, wherein the interface comprises at least one anchor, and wherein the tightening element is attached to the at least one anchor.

5. The apparatus of claim 4, wherein the at least one anchor is adapted to non-releasably attach the tightening element to the interface.

6. The apparatus of claim 4, wherein the at least one anchor is adapted to releasably attach the tightening element to the interface.

7. The apparatus of claim 4, wherein the anchor comprises a lumen for receiving a portion of the tightening element threaded therethrough.

8. The apparatus of claim 4, wherein the anchor comprises a pulley for receiving the tightening element.

9. The apparatus of claim 4, wherein the anchor comprises means for attaching the tightening element to the interface.

10. The apparatus of claim 1, wherein the strap is attached at at least two locations on opposite sides of the interface and is adapted to hold down a heel of the boot to the interface.

11. The apparatus of claim 1, wherein the strap body has a longitudinal axis, and wherein the tightening element is routed over the strap body so that a portion of the tightening element extends substantially parallel to the longitudinal axis.

12. The apparatus of claim 1, wherein the strap body comprises at least a portion thereof formed of a substantially rigid material.

13. The apparatus of claim 1, wherein a first portion of the strap body is mounted to the interface via the tightening element, and wherein a second portion of the strap body is directly attached to the interface.

14. The apparatus of claim 1, wherein the strap body is adapted to distribute pressure exerted thereon by the tightening element across the strap body.

15. The apparatus of claim 1, wherein the strap body comprises at least one lumen that receives the tightening element.

16. The apparatus of claim 15, wherein the at least one lumen extends substantially parallel to a longitudinal axis of the strap body.

17. The apparatus of claim 1, wherein the tightening element is non-releasably and movably attached to the interface at a first location and is releasably and movably attached to the interface at a second location.

18. The apparatus of claim 1, wherein the tightening element comprises a first end fixedly attached to the interface, so that the first end of the tightening element does not move relative to the interface as the strap is tightened.

19. The apparatus of claim 1, wherein the tightening element has sufficient length such that upon unwinding the tightening element from the spool, there is sufficient slack in the strap to enable the boot to engage and disengage with the interface.

20. The apparatus of claim 1, wherein the closure device comprises a ratchet and pawl, coupled to the spool, for holding the tightening element in a plurality of incremental locked positions.

21. The apparatus of claim 1, wherein the tightening element is formed of a low-friction material.

22. The apparatus of claim 1, wherein the tightening element is routed across the strap body to create a hold down area wherein the strap body is held down by the tightening element on to the snowboard boot, the closure device being mounted to the strap body outside of the hold down area, so that the closure device does not bear on the snowboard boot when the strap is tightened.

23. The apparatus of claim 1, wherein the closure device is detachably mounted to the strap body.

24. The apparatus of claim 1, wherein the interface comprises a step-in mating feature adapted to be releasably engaged by the snowboard binding.

25. The apparatus of claim 1, wherein the binding comprises an engagement member to engage with the interface and is separate from the tightening element.

26. The apparatus of claim 1, wherein the closure device comprises a body and wherein the spool is rotatably mounted to the closure device body.

27. The apparatus of claim 1, wherein the closure device comprises a body and an actuator that is rotatably mounted to the closure device body, the actuator being operatively associated with the spool to wind the tightening element about the spool to tighten the strap.

28. The apparatus of claim 1, wherein the closure device comprises means for wrapping the tightening element about the spool to tighten the strap in a plurality of incremental locked positions.

29. The apparatus of claim 1, wherein the tightening element comprises a smooth outer surface over its entire length.

30. The apparatus of claim 1, wherein the strap body is padded.

31. The apparatus of claim 1, wherein the strap body comprises a guide that receives at least a portion of the tightening element.

32. An apparatus comprising:

a snowboard boot binding interface for interfacing a snowboard boot to a snowboard binding; and a strap, supported by the interface, to hold the interface to the snowboard boot, the strap comprising:

a tightening element attached to the interface; and a closure device, supported by the interface, comprising a spool about which the tightening element is wrapped to tighten the strap to secure the interface to the boot, wherein the interface comprises at least one anchor, wherein the tightening element is attached to the at least one anchor, wherein the at least one anchor comprises at least first and second anchors, and wherein the tightening element is movably mounted to each of the first and second anchors, so that a portion of the tightening element in engagement with each of the first and second anchors changes as the tightening element is wrapped around the spool to tighten the strap.

33. The apparatus of claim 32, wherein the strap further comprises a strap body supported by the tightening element and wherein the first and second anchors are disposed on opposite sides of the interface so that when the tightening element is wrapped around to the spool to tighten the strap, the strap body cinches down over a surface of the snowboard boot.

34. The apparatus of claim 32, wherein the closure device is adapted to simultaneously draw at least two separate ends of the tightening element on to the spool when the strap is tightened.

35. The apparatus of claim 32, wherein the closure device is mounted directly to the interface.

36. The apparatus of claim 32, wherein the strap comprises a strap body supported by the tightening element, and wherein the closure device is mounted to the strap body.

37. The apparatus of claim 32, wherein the strap body is padded.

38. The apparatus of claim 32, wherein the strap comprises a strap body supported by the tightening element, and wherein the strap body comprises a guide that receives at least a portion of the tightening element.

39. An apparatus comprising:

a snowboard boot binding interface for interfacing a snowboard boot to a snowboard binding, the interface having opposed anchors; and a strap, supported by the interface, to hold the interface to the snowboard boot, the strap comprising:

a tightening element attached to the interface, the tightening element having opposed end portions engageable with the anchors; and a closure device supported by the interface, the closure device comprising a housing and a spool rotatably mounted relative to the housing, the tightening element being wrapped around the spool to tighten the tightening element to secure the interface to the boot, wherein the strap further comprises a strap body supported by the tightening element, the apparatus further comprising a sheath, supported by the strap body, that encases at least a portion of the tightening element.

40. The apparatus of claim 39, wherein the sheath is formed of a low-friction material.

41. The apparatus of claim 40, wherein the tightening element is formed of a low-friction material.

42. The apparatus of claim 39, wherein the sheath is formed of an incompressible material.

43. The apparatus of claim 39, wherein the sheath comprises multiple separate sections, wherein the closure device has at least one opening through which the tightening element passes to exit the closure device, and wherein the at least one opening is in-line with a longitudinal axis of one of the sections of the sheath.

44. The apparatus of claim 39, wherein the strap body comprises a lumen that at least partially encloses the sheath.

45. The apparatus of claim 37, wherein the closure device is mounted directly to the interface.

46. The apparatus of claim 39, wherein the closure device is mounted to the strap body.

47. The apparatus of claim 39, wherein the strap body is padded.

48. An apparatus comprising:

a snowboard boot binding interface for interfacing a snowboard boot to a snowboard binding, the interface having opposed anchors; and a strap, supported by the interface, to hold the interface to the snowboard boot, the strap comprising:

a tightening element attached to the interface, the tightening element having opposed end portions engageable with the anchors; and a closure device supported by the interface, the closure device comprising a housing and a spool rotabably mounted relative to the housing, the tightening element being wrapped around the spool to tighten the tightening element to secure the interface to the boot, wherein the closure device is adapted to simultaneously draw at least two separate ends of the tightening element onto the spool when the strap is tightened.

49. The apparatus of claim 48, wherein the closure device is mounted directly to the interface.

50. The apparatus of claim 48, wherein the strap comprises a strap body supported by the tightening element, and wherein the closure device is mounted to the strap body.

51. The apparatus of claim 48, wherein the strap further comprises a strap body supported by the tightening element, and wherein the strap body is padded.

52. The apparatus of claim 48, wherein the strap further comprises a strap body supported by the tightening element, and wherein the strap body comprising a guide that receives at least a portion of the tightening element.

53. The apparatus of claim 48, wherein the strap further comprises a strap body supported by the tightening element, and wherein the tightening element is movable relative to the strap body as the closure device tightens the strap to secure the interface to the boot.

54. An apparatus comprising:

a snowboard boot binding interface for interfacing a snowboard boot to a snowboard binding; and a strap, supported by the interface, to hold the interface to the snowboard boot, the strap comprising:

a tightening element attached to the interface; and a closure device, supported by the interface, comprising a body and an actuator that is rotatably mounted to the body and is coupled to the tightening element so that rotation of the actuator causes the tightening element to be drawn into the closure device body to tighten the strap, wherein the interface comprises at least one anchor, and wherein the tightening element is attached to the at least one anchor, wherein the at least one anchor comprises at least first and second anchors, and wherein the tightening element is routed to and redirected by each of the first and second anchors, so that a portion of the tightening element in engagement with each of the first and second anchors changes as the tightening element is drawn into the closure device body to tighten the strap, wherein the strap further comprises a strap body supported by the tightening element and wherein the first and second anchors are disposed on opposite sides of the interface so that when the tightening element is wrapped around the spool to tighten the strap, the strap body cinches down over a surface of the snowboard boot.

55. The apparatus of claim 54, wherein the closure device is mounted directly to the interface.

56. The apparatus of claim 54, wherein the closure device is mounted to the strap body.

57. The apparatus of claim 54, wherein the strap body is padded.

58. The apparatus of claim 54, wherein the strap body comprises a guide that receives at least a portion of the tightening element.

59. An apparatus comprising:

a snowboard boot binding interface for interfacing a snowboard boot to a snowboard binding, the interface having opposed anchors; and a strap, supported by the base, to hold the interface to the snowboard boot, the strap comprising:

a tightening element attached to the interface, the tightening element having opposed end portions engageable with the anchors, wherein the tightening element is a cable that is round in cross-section; and a closure device supported by the interface, the closure device comprising a housing and a spool rotabably mounted relative to the housing, the tightening element being wrapped around the spool to tighten the tightening element to secure the interface to the boot.

60. The apparatus of claim 59, further comprising a closure device that is coupled to the tightening element, wherein the closure device is mounted directly to the interface.

61. The apparatus of claim 59, further comprising a closure device that is coupled to the tightening element, wherein the strap further comprises a strap body supported by the tightening element, and wherein the closure device is mounted to the strap body.

62. The apparatus of claim 59, wherein the strap further comprises a strap body supported by the tightening element, and wherein the strap body is padded.

63. The apparatus of claim 59, wherein the strap further comprises a strap body supported by the tightening element, and wherein the strap body comprises a guide that receives at least a portion of the tightening element.

64. The apparatus of claim 59, wherein the strap further comprises a strap body supported by the tightening element, and wherein the tightening element is movable relative to the strap body as the tightening element is tightened to secure the interface to the boot.

65. An apparatus comprising:

a snowboard boot binding interface for interfacing a snowboard boot to a snowboard binding, the interface having opposed anchors; and a strap, supported by the base, to hold the snowboard boot in the binding, the strap comprising:

a tightening element attached to the interface, the tightening element having opposed end portions engageable with the anchors, wherein the strap further comprises a strap body supported by the tightening element, the apparatus further comprising a sheath, supported by the strap body, that encases at least a portion of the tightening element; and a closure device supported by the interface, the closure device comprising a housing and a spool rotabably mounted relative to the housing, the tightening element being wrapped around the spool to tighten the tightening element to secure the interface to the boot.

66. The apparatus of claim 65, further comprising a closure device that is coupled to the tightening element, the closure device is mounted directly to the interface.

67. The apparatus of claim 65, further comprising a closure device that is coupled to the tightening element, and wherein the closure device is mounted to the strap body.

68. The apparatus of claim 65, wherein the strap body is padded.

69. An apparatus, comprising:

a snowboard boot binding interface for interfacing a snowboard boot to a snowboard binding, the interface comprising opposed strap anchors; and a strap to hold the interface to the snowboard boot, the strap comprising:

a tightening cable comprising opposed looped ends, each looped end being attached to a respective anchor, the looped end being formed as a result of the tightening cable being routed to and redirected by a portion of the anchor so that the tightening cable can be drawn in one direction about the portion of the anchor to tighten the tightening element; and a closure device supported by the interface, the closure device comprising a housing and a spool rotabably mounted relative to the housing, the tightening element being wrapped around the spool to tighten the tightening element to secure the interface to the boot.

70. The apparatus of claim 69, wherein the at least one anchor comprises first and second anchors disposed on opposite sides of the interface, and wherein the tightening cable comprises first and second loop ends respectively routed to and redirected by portions of the first and second anchors.

71. The apparatus of claim 69, further comprising a closure device that is coupled to the tightening cable and is adapted to draw the tightening cable about the portion of the at least one anchor to tighten the strap.

72. The apparatus of claim 71, wherein the strap further comprises a strap body, supported by the tightening element, adapted to overlie the snowboard boot, the closure device being mounted to the strap body.

73. The apparatus of claim 71, wherein the closure device is adapted to draw the tightening cable into the closure device to tighten the strap.

74. The apparatus of claim 73, wherein the closure device is adapted to simultaneously draw at least two separate ends of the tightening cable into the closure device to tighten the strap.

75. The apparatus of claim 69, wherein the at least one anchor is adapted to non-releasably attach the tightening cable to the interface.

76. The apparatus of claim 69, wherein the interface comprises a step-in mating feature adapted to be releasably engaged by the snowboard binding.

77. The apparatus of claim 69, wherein the binding includes an engagement member to engage with the interface and is separate from the tightening cable.

78. The apparatus of claim 69, wherein the strap further comprises a strap body supported by the tightening cable, and wherein the strap body is padded.

79. The apparatus of claim 69, wherein the strap further comprises a strap body, supported by the tightening element, and wherein the strap body comprises a guide that receives at least a portion of the tightening element.

80. The apparatus of claim 69, wherein the apparatus further comprises a closure device that is mounted directly to the interface.

81. An apparatus comprising:

a snowboard boot binding interface for interfacing a snowboard boot to a snowboard binding, the interface including opposed strap anchors; and a strap to hold the interface to the snowboard boot, the strap comprising:

a tightening cable comprising opposed looped ends, each looped end being attached to a respective anchor, the tightening cable being routed to and redirected by a portion of the so that the tightening cable can be drawn in one direction about the portion of the at least one anchor to tighten the strap, wherein the tightening cable is round in cross-section; and a closure device supported by the interface, the closure device comprising a housing and a spool rotabably mounted relative to the housing, the tightening element being wrapped around the spool to tighten the tightening element to secure the interface to the boot.

82. The apparatus of claim 81, further comprising a closure device that is coupled to the tightening cable and is adapted to draw the tightening cable about the portion of the at least one anchor to tighten the strap.

83. The apparatus of claim 82, wherein the strap further comprises a strap body supported by the tightening cable, wherein the closure device is mounted to the strap body.

84. The apparatus of claim 82, wherein the strap further comprises a strap body supported by the tightening cable, and wherein the strap body is padded.

85. The apparatus of claim 82, wherein the closure device is mounted directly to the interface.

86. An apparatus comprising:

a snowboard boot binding interface for interfacing a snowboard boot to a snowboard binding, the interface comprising including opposed strap anchors, and a strap to hold the snowboard boot to the interface, the strap comprising:

a tightening cable comprising opposed looped ends, each looped end being attached to a respective anchor, the tightening cable being routed to and redirected by a portion of the at least one anchor so that the tightening cable can be drawn in one direction about the portion of the at least one anchor to tighten the strap, wherein the strap further comprises a strap body, supported by the tightening cable, adapted to overlie the snowboard boot, the strap body comprising at least one lumen that receives the tightening cable; and a closure device supported by the interface, the closure device comprising a housing and a spool rotabably mounted relative to the housing, the tightening element being wrapped around the spool to tighten the tightening element to secure the interface to the boot.

87. The apparatus of claim 86, further comprising a closure device that is coupled to the tightening cable and is adapted to draw the tightening cable about the portion of the at least one anchor to tighten the strap.

88. The apparatus of claim 87, wherein the closure device is mounted to the strap body.

89. The apparatus of claim 87, wherein the strap body is padded.

90. The apparatus of claim 87, wherein the apparatus further comprises a closure device that is mounted directly to the interface.

91. An apparatus comprising:

a snowboard boot binding interface for interfacing a snowboard boot to a snowboard binding, the interface comprising opposed anchors; and a strap to hold the interface to the snowboard boot, the strap comprising:

a tightening cable comprising opposed looped ends, each looped end being attached to a respective anchor, the tightening cable being routed to and redirected by a portion of the at least one anchor so that the tightening cable can be drawn in one direction about the portion of the at least one anchor to tighten the strap, wherein the strap further comprises a strap body, supported by the tightening cable, adapted to overlie the snowboard boot, the strap further comprising a sheath, supported by the strap body, that encases at least a portion of the tightening cable; and a closure device supported by the interface, the closure device comprising a housing and a spool rotabably mounted relative to the housing, the tightening element being wrapped around the spool to tighten the tightening element to secure the interface to the boot.

92. The apparatus of claim 91, further comprising a closure device that is coupled to the tightening cable and is adapted to draw the tightening cable about the portion of the at least one anchor to tighten the strap.

93. The apparatus of claim 92, wherein the closure device is mounted to the strap body.

94. The apparatus of claim 92, wherein the strap body is padded.

95. The apparatus of claim 92, wherein the apparatus further comprises a closure device that is mounted directly to the interface.

96. An apparatus, comprising:

a snowboard boot binding interface for interfacing a snowboard boot to a snowboard binding, the interface having opposed anchors;

a strap, supported by the interface, to hold the interface to the snowboard boot, the strap comprising:

a tightening element attached to the interface, the tightening element having opposed end portions engageable with the anchors;

a strap body supported by the tightening element, wherein the strap body is padded; and a closure device supported by the interface, the closure device comprising a housing and a spool rotabably mounted relative to the housing, the tightening element being wrapped around the spool to tighten the tightening element to secure the interface to the boot.

97. The apparatus of claim 96, wherein the closure device is mounted to the strap body.

98. The apparatus of claim 96, wherein the closure device is mounted directly to the interface.

99. The apparatus of claim 96, wherein the interface comprises at least one anchor, and wherein the tightening element is attached to the at least one anchor.

100. The apparatus of claim 99, wherein the at least one anchor is adapted to nonreleasably attach the tightening element to the interface.

101. The apparatus of claim 99, wherein the at least one anchor is adapted to releasably attach the tightening element to the interface.

102. The apparatus of claim 99, wherein the at least one anchor comprises at least first and second anchors, and wherein the tightening element is movably mounted to each of the first and second anchors, so that a portion of the tightening element in engagement with each of the first and second anchors changes as the tightening element is wrapped around the spool to tighten the strap.

103. The apparatus of claim 102, wherein the first and second anchors are disposed on opposite sides of the interface so that when the tightening element is wrapped around to the spool to tighten the strap, the strap body cinches down over a surface of the snowboard boot.

104. The apparatus of claim 96, wherein the tightening element is a cable that is round in cross-section.

105. The apparatus of claim 96, wherein a first portion of the strap body is mounted to the apparatus via the tightening element, and wherein a second portion of the strap body is mounted directly to the interface.

106. The apparatus of claim 96, further comprising a sheath, supported by the strap body, that encases at least a portion of the tightening element.

107. The apparatus of claim 96, wherein the closure device is adapted to simultaneously draw at least two separate ends of the tightening element onto the spool when the strap is tightened.

108. The apparatus of claim 96, wherein the tightening element comprises a first end fixedly attached to the interface, so that the first end of the tightening element does not move relative to the interface as the strap is tightened.

109. The apparatus of claim 96, wherein the binding further comprises a highback mounted thereto.

110. The apparatus of claim 96, wherein the closure device comprises a body, and wherein the spool is rotatably mounted to the closure device body.

111. The apparatus of claim 96, wherein the closure device comprises a body, and an actuator that is rotatably mounted to the closure device body, the actuator being operatively associated with the spool to wind the tightening element about the spool to tighten the strap.

* * * * *